US010584892B2

(12) United States Patent
Sasaki et al.

(10) Patent No.: US 10,584,892 B2
(45) Date of Patent: Mar. 10, 2020

(54) AIR-CONDITIONING CONTROL METHOD, AIR-CONDITIONING CONTROL APPARATUS, AND STORAGE MEDIUM

(71) Applicant: Panasonic Intellectual Property Management Co., Ltd., Osaka (JP)

(72) Inventors: Taiji Sasaki, Osaka (JP); Masaaki Harada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 89 days.

(21) Appl. No.: 15/911,671

(22) Filed: Mar. 5, 2018

(65) Prior Publication Data

US 2018/0195752 A1 Jul. 12, 2018

Related U.S. Application Data

(63) Continuation of application No. PCT/JP2016/004057, filed on Sep. 6, 2016.

(30) Foreign Application Priority Data

Oct. 1, 2015 (JP) ..... 2015-195569
Jul. 25, 2016 (JP) ..... 2016-145253

(51) Int. Cl.
*F24F 11/64* (2018.01)
*F24F 11/61* (2018.01)
(Continued)

(52) U.S. Cl.
CPC ..... *F24F 11/64* (2018.01); *F24F 11/46* (2018.01); *F24F 11/61* (2018.01); *F24F 11/80* (2018.01);
(Continued)

(58) Field of Classification Search
CPC .. F24F 11/46; F24F 11/61; F24F 11/64; F24F 11/80; F24F 2110/10; F24F 2110/20; F24F 2120/10; F24F 2130/10
See application file for complete search history.

(56) References Cited

U.S. PATENT DOCUMENTS

2010/0138363 A1* 6/2010 Batterberry ..... G06Q 10/04 705/412
2012/0310376 A1* 12/2012 Krumm ..... G05B 15/02 700/31
(Continued)

FOREIGN PATENT DOCUMENTS

EP 3040633 7/2016
EP 3040633 A1 * 7/2016 ..... F25B 13/00
(Continued)

OTHER PUBLICATIONS

International Search Report of PCT application No. PCT/JP2016/004057 dated Dec. 6, 2016.

*Primary Examiner* — Jason Lin
(74) *Attorney, Agent, or Firm* — Greenblum & Bernstein, P.L.C.

(57) ABSTRACT

A cloud server includes an environment history DB storing in-room temperature history information representing a history of an in-room temperature change in a living room whose temperature is adjusted by an air-conditioner in relation to operation history information representing an operation history of the air-conditioner, an in-room environment predictor that predicts, as a predicted off-state in-room temperature, a future in-room temperature of the living room based on the in-room temperature history information and the operation history information for a case where the temperature is not adjusted by the air-conditioning apparatus, and an air conditioning setting unit that determines, based on the predicted off-state in-room temperature, a
(Continued)

control parameter of the air-conditioner used to control the in-room temperature so as to reach a target temperature at a target time.

11 Claims, 19 Drawing Sheets

(51) Int. Cl.

| | |
|---|---|
| ***F24F 11/80*** | (2018.01) |
| ***F24F 11/46*** | (2018.01) |
| *F24F 120/10* | (2018.01) |
| *F24F 110/10* | (2018.01) |
| *F24F 110/20* | (2018.01) |
| *F24F 130/10* | (2018.01) |

(52) U.S. Cl.
CPC ..... *F24F 2110/10* (2018.01); *F24F 2110/20* (2018.01); *F24F 2120/10* (2018.01); *F24F 2130/10* (2018.01)

(56) References Cited

U.S. PATENT DOCUMENTS

| | | | | |
|---|---|---|---|---|
| 2013/0144445 | A1* | 6/2013 | Steinberg | G05D 23/1923 700/278 |
| 2015/0167996 | A1* | 6/2015 | Fadell | G05D 23/1917 700/276 |
| 2015/0330652 | A1* | 11/2015 | Kim | G05B 15/02 700/276 |
| 2016/0201934 | A1* | 7/2016 | Hester | F24F 11/30 700/276 |
| 2016/0334122 | A1* | 11/2016 | Shiel | F24F 11/0001 |

FOREIGN PATENT DOCUMENTS

| | | |
|---|---|---|
| JP | 56-151828 | 11/1981 |
| JP | 6-042765 | 2/1994 |
| JP | 2004-012006 | 1/2004 |
| JP | 2005-229758 | 8/2005 |
| JP | 2011-247435 | 12/2011 |
| JP | 2013-204985 | 10/2013 |
| JP | 2013-224812 | 10/2013 |
| WO | 2015/029177 | 3/2015 |

* cited by examiner

FIG. 2

| ID | TIME | IN-ROOM TEMPERATURE (°C) | IN-ROOM HUMIDITY (%) | OUTSIDE-ROOM TEMPERATURE (°C) | OUTSIDE-ROOM HUMIDITY (%) | OPERATION STATUS | OPERATION MODE | SET TEMPERATURE (°C) | AIR FLOW RATE | AIR FLOW DIRECTION |
|---|---|---|---|---|---|---|---|---|---|---|
| 1 | 7/17/2015 10:00 | 30.0 | 50 | 32.9 | 55 | OFF | — | — | — | — |
| 2 | 7/17/2015 10:05 | 30.1 | 50 | 33.0 | 54 | OFF | — | — | — | — |
| 3 | 7/17/2015 10:10 | 30.2 | 51 | 33.1 | 55 | OFF | — | — | — | — |
| 4 | 7/17/2015 10:15 | 30.2 | 50 | 33.2 | 55 | ON | COOLING | 25 | LV 5 | DIR 1 |
| 5 | 7/17/2015 10:20 | 30.0 | 49 | 33.3 | 54 | ON | COOLING | 25 | LV 5 | DIR 1 |
| 6 | 7/17/2015 10:25 | 29.7 | 49 | 33.4 | 55 | ON | COOLING | 25 | LV 5 | DIR 1 |
| ... | | | | | | | | | | |

AIR-CONDITIONING CONTROL METHOD, AIR-CONDITIONING CONTROL APPARATUS, AND STORAGE MEDIUM

BACKGROUND

1. Technical Field

The present disclosure relates to an air-conditioning control apparatus connected to an air-conditioning apparatus via a network, an air-conditioning control method of an air-conditioning control apparatus, and a storage medium, and more particularly, to an air-conditioning control method for an air-conditioning control apparatus connected to an air-conditioner via network.

2. Description of the Related Art

In recent years, many types of home-use AV apparatuses such as a television set, a recorder, and the like capable of being connected to the Internet have been increasingly used, and services of distributing video contents such as movies, sports, or the like are provided. Not only home-used AV apparatuses, but also other many types of home-use apparatuses called home appliances are now capable of being connected to the Internets, and various kinds of services are provided. Examples of such home-use apparatuses include an air-conditioner, a scale, an activity meter, a rice cooker, a microwave oven, a refrigerator, etc. An example of such a service associated with a home appliance is a system in which an air-conditioner is remotely controlled using an information terminal capable of being connected to the Internet.

Japanese Unexamined Patent Application Publication 2013-204985 discloses an in-room temperature control system in which temperature of a living room as of a user's wake-up time is predicted based on temperature of the living room at a present time and a time period from the present time to the user's wake-up time, and a time of starting a floor heating apparatus is set based on a difference between a set temperature of the floor heating apparatus and the predicted temperature of the living room at the wake-up time.

However, the system described above needs a further improvement.

SUMMARY

In one general aspect, the techniques disclosed here feature an air-conditioning control method for an air-conditioning control apparatus connected to an air-conditioning apparatus via a network, including storing, in a database, in-room temperature history information representing a history of an in-room temperature change in a living room whose temperature is adjusted by the air-conditioning apparatus in relation to operation history information representing an operation history of the air-conditioning apparatus, predicting, as a predicted off-state in-room temperature, a future in-room temperature of the living room based on the in-room temperature history information and the operation history information for a case where the temperature is not adjusted by the air-conditioning apparatus, and determining, based on the predicted off-state in-room temperature, a control parameter of the air-conditioning apparatus, the control parameter being used for controlling the in-room temperature of the living room to reach a target temperature at a target time.

The air-conditioning control method according to this aspect makes it possible to achieve a further improvement.

That is, according to the aspect of the present disclosure, it is possible to control the air-conditioning apparatus so as to provide a comfortable environment to a user while achieving a reduction in consumption power.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 2 is a diagram illustrating an example of a data structure stored in an environment history DB shown in FIG. 1;

DETAILED DESCRIPTION

Figure 1:
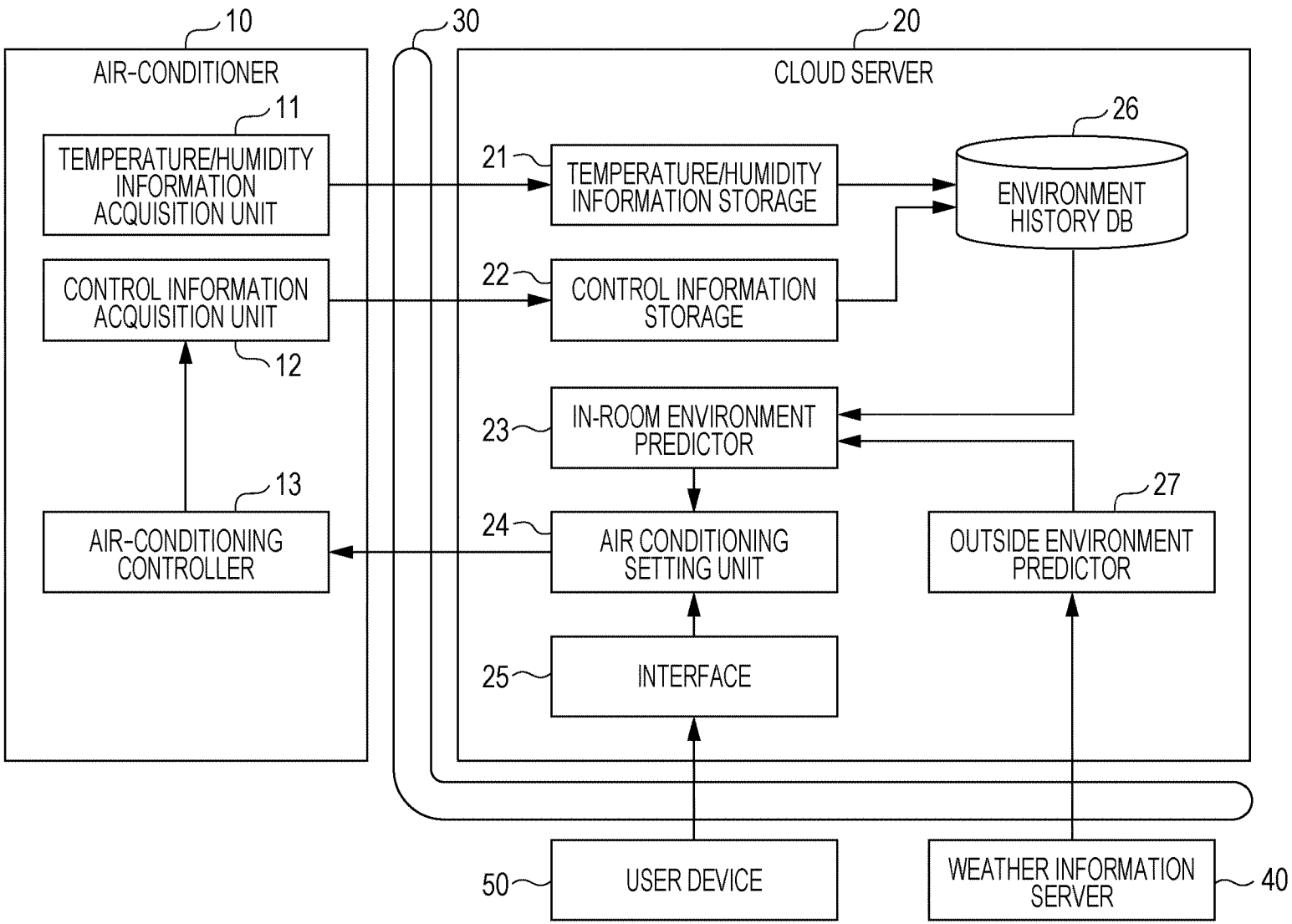
FIG. 1 is a block diagram illustrating an example of a configuration of an air-conditioning control system according to an embodiment of the present disclosure.

Underlying Knowledge Forming Basis of the Present Disclosure

In an air-conditioner remote control system, for example, it is allowed to transmit a control command to an air-conditioner from an information terminal via the Internet, which makes it possible to control an air-conditioner installed in a user's house from an outside place. By using this service, it is possible to turn on the air-conditioner from an outside place before a user returns home such that when the user returns home, a user's room has been cooled or heated to a desired temperature.

In a case where the air-conditioner is set manually using a remote control before a user returns home, if there is too large a time difference between a time of setting the air-conditioner and a return-home time, there is a possibility that the room is excessibly cooled or heated, which results in a waste of electric energy in operation of the air-conditioner. On the other hand, in a case where the air-conditioner is remotely set too short a period before the return-home time, there is a possibility that the room is not cooled or heated enough.

The in-room temperature control system disclosed in Japanese Unexamined Patent Application Publication 2013-204985, temperature of a living room as of a user's wake-up time is predicted based on temperature of the living room at a present time and a time period from the present time to the user's wake-up time, and an operation start time of a floor heating apparatus is set based on a difference between a set temperature of the floor heating apparatus and the predicted temperature of the living room at the wake-up time. This makes it possible to prevent the room from being heated deficiently or excessively, and it becomes possible to provide better comfortableness in the living room when a user wakes up and it also becomes possible to improve energy saving.

However, in the technique disclosed in Japanese Unexamined Patent Application Publication 2013-204985, a change in temperature in the living room in a period from the present time to the user's wake-up time is predicted based on a calculation using a linear model, and thus the accuracy of the prediction of the temperature change is not high. Besides, a temperature change due to floor heating is not taken into account. Therefore, depending on the environment of the living room, it is difficult to accurately predict the temperature change, which may result in excessive or deficient heating.

The present disclosure provides an air-conditioning control method, an air-conditioning control apparatus, and a storage medium storing an air-conditioning control program to control an air-conditioning apparatus so as to provide a comfortable environment to a user with reduced consumption power.

To achieve an improvement in function of air-conditioning control apparatuses connected, via a network, to an air-conditioning apparatus that controls a temperature of a living room, the present disclosure provides a technique according to various aspects as described below.

According to an aspect, the present disclosure provides an air-conditioning control method for an air-conditioning control apparatus connected to an air-conditioning apparatus via a network, including storing, in a database, in-room temperature history information representing a history of an in-room temperature change in a living room whose temperature is adjusted by the air-conditioning apparatus in relation to operation history information representing an operation history of the air-conditioning apparatus, predicting, as a predicted off-state in-room temperature, a future in-room temperature of the living room based on the in-room temperature history information and the operation history information for a case where the temperature is not adjusted by the air-conditioning apparatus, and determining, based on the predicted off-state in-room temperature, a control parameter of the air-conditioning apparatus, the control parameter being used for controlling the in-room temperature of the living room to reach a target temperature at a target time.

In this aspect, based on the in-room temperature history information and the operation history information, the air-conditioning apparatus predicts, as the predicted off-state in-room temperature, the future in-room temperature of the living room for the case where the temperature is not adjusted by the air-conditioning apparatus. Based on the predicted off-state in-room temperature, the determination is performed as to the control parameter of the air-conditioning apparatus for achieving the target temperature in the living room at the target time. Thus, it is possible to properly control the air-conditioning apparatus adaptively to a change in the environment of the living room even caused by a change with time in the house or performance of the air-conditioning apparatus, and it is possible to achieve high accuracy in the prediction of the in-room temperature in the state in which the air-conditioning apparatus is operated and in the state in which the air-conditioning apparatus is not operated. Thus, it is possible to control the air-conditioning apparatus according to the target temperature and the target time specified by the user with reduced consumption power so as to provide a comfortable environment to the user.

According to an aspect, the air-conditioning control method may further include receiving target temperature information representing a target temperature of a living room whose temperature is adjusted by the air-conditioning apparatus, and set time information representing a target time at which the temperature of the living room is controlled so as to reach the target temperature, determining a control parameter of the air-conditioning apparatus based on the predicted off-state in-room temperature such that the in-room temperature of the living room reaches the target temperature indicated by the target temperature information at the target time indicated by the set time information, and transmitting, to the air-conditioning apparatus, control command information including the determined control parameter, the control command information indicating an operation command to operate the air-conditioning apparatus according to the control parameter.

In this aspect, information is received as to the target temperature information representing the target temperature of the living room and the set time information representing the target time at which the temperature of the living room is controlled so as to reach the target temperature. Based on the predicted off-state in-room temperature, the determination is performed as to the control parameter of the air-conditioning apparatus such that the in-room temperature of the living room reaches the target temperature indicated by the target temperature information at the target time indicated by the set time information. The control command information including the determined control parameter and indicating the operation command to operate the air-conditioning apparatus according to the control parameter is transmitted to the air-conditioning apparatus. Thus, even when a change occurs in the environment of the living room such as aging degradation in the house or the air-conditioning apparatus, it is possible to accurately control the temperature of the living room such that the target temperature indicated by the target temperature information is reached at the target time indicated by the set time information.

According to an aspect, the air-conditioning control method may further include predicting, as a predicted on-state in-room temperature, a future in-room temperature of the living room based on the in-room temperature history information and the operation history information for the case where the temperature is adjusted by the air-conditioning apparatus, and determining a control parameter of the air-conditioning apparatus based on the predicted off-state in-room temperature and the predicted on-state in-room temperature.

In this aspect, based on the in-room temperature history information and the operation history information, the prediction of the predicted on-state in-room temperature is performed as to the future in-room temperature of the living room for the case where the temperature is adjusted by the air-conditioning apparatus. Based on the predicted off-state in-room temperature and the predicted on-state in-room temperature, the control parameter of the air-conditioning apparatus is determined. Thus, even when a change occurs in the environment of the living room such as aging degradation in the house or the air-conditioning apparatus, it is possible to achieve high accuracy in the prediction of the in-room temperature in the state in which the air-conditioning apparatus is operated and in the state in which the air-conditioning apparatus is not operated. Thus, it is possible to control the air-conditioning apparatus according to the target temperature and the target time specified by the user with further reduced consumption power so as to provide a more comfortable environment to the user.

According to an aspect, the air-conditioning control method may further include storing power consumption history information representing a history of electric power consumption of the air-conditioning apparatus in the database, predicting, as a predicted on-state electric power consumption, a future electric power consumption of the air-conditioning apparatus based on the in-room temperature history information, the operation history information, and the power consumption history information for the case where the temperature is adjusted by the air-conditioning apparatus, and determining the control parameter based on the predicted off-state in-room temperature, the predicted on-state in-room temperature, and the predicted on-state electric power consumption.

In this aspect, based on the in-room temperature history information, the operation history information, and the power consumption history information, the prediction is performed as to the predicted on-state electric power consumption in terms of the further consumption power of the air-conditioning apparatus for the case where the temperature is adjusted by the air-conditioning apparatus. Based on the predicted off-state in-room temperature, the predicted on-state in-room temperature, and the predicted on-state electric power consumption, the control parameter of the air-conditioning apparatus is determined. Thus, even when a change occurs in the environment of the living room such as aging degradation in the house or the air-conditioning apparatus, it is possible to achieve high accuracy in prediction of the in-room temperature in the state in which the air-conditioning apparatus is operated and in the state in which the air-conditioning apparatus is not operated, and also it is possible to achieve high accuracy in prediction of the electric power consumption when the air-conditioning apparatus is operated. Thus, it is possible to control the air-conditioning apparatus according to the target temperature and the target time specified by the user with further reduced consumption power so as to provide a more comfortable environment to the user.

In the air-conditioning control method according to the aspect, the control parameter may include start time information indicating a time at which to start an operation of the air-conditioning apparatus.

In this aspect, it becomes possible to start the air-conditioning apparatus accurately at the time indicated by the start time information and perform the above-described control.

In the air-conditioning control method according to an aspect, the control parameter may include operation pattern information indicating an operation pattern according to which to operate the air-conditioning apparatus.

In this aspect, it becomes possible to accurately control the air-conditioning apparatus according to the operation pattern indicated by the operation pattern information.

According to an aspect, the air-conditioning control method may further include storing at least one of enter-room history information representing enter-room history of a user in the living room and leave-room history information representing leave-room history of the user from the living room, and estimating a usage time at which the user uses the living room based on at least one of the enter-room history information and the leave-room history information, and determining the usage time as the target time.

In this aspect, based on at least one of the enter-room history information and the leave-room history information, the estimation is performed as to the usage time at which the living room is used by the user, and this usage time is determined as the target time. Thus, it is possible to automatically set the usage time when a user uses his/her living room such that the target time is set to a time at which the target temperature is desired to be reached.

According to an aspect, the air-conditioning control method may further include receiving, via the network, a result of a detection by a human sensor disposed in the living room in terms of whether the user is present or absent in the living room, and updating at least one of the enter-room history information and the leave-room history information based on the result of the detection by the human sensor.

According this aspect, it becomes possible to automatically update at least one of the enter-room history information and the leave-room history information, and thus, based on the usage history of the user, it becomes possible to automatically set the usage time when the user uses his/her living room such that the target time is set to a time at which the target temperature is desired to be reached.

According to an aspect, the air-conditioning control method may further include receiving, via the network, GPS (Global Positioning System) information on an information terminal possessed by the user, determining at least one of the user entering the living room and the user leaving the living room based on the GPS information received from the information terminal, and updating at least one of the enter-room history information and the leave-room history information based on the determined at least one of the entering room and the leaving room.

In this aspect, it is possible to automatically update at least one of the enter-room history information and the leave-room history information using GPS information indicating the location of the information terminal possessed by the user, and thus, based on the usage history of the user without having to use an additional sensor such as a human sensor or the like, it is possible to automatically set the usage time when the user uses his/her living room such that the target time is set to the time at which the target temperature is desired to be reached.

According to an aspect, the air-conditioning control method may further include storing, in the databased, at least one of outside-room temperature history information representing a history of a change in temperature outside the living room and opening/closing history information representing a history of opening/closing of a window of the living room, and determining the control parameter based on the in-room temperature history information and the operation history information and further at least one of the outside-room temperature history information and the opening/closing history information.

In this aspect, the control parameter is determined based on the in-room temperature history information and the operation history information and further at least one of the outside-room temperature history information and the opening/closing history information. Thus, even when a change occurs in the environment of the living room such as aging degradation in the house or the air-conditioning apparatus, it is possible to achieve high accuracy in the prediction of the in-room temperature in the state in which the air-conditioning apparatus is operated and in the state in which the air-conditioning apparatus is not operated. Thus, it is possible to control the air-conditioning apparatus according to the target temperature and the target time specified by the user with further reduced consumption power so as to provide a more comfortable environment to the user.

According to an aspect, the air-conditioning control method may further include storing, in the database, temperature range information indicating a temperature range in which the user is allowed to live comfortably, wherein the target temperature includes an upper limit or a lower limit of the temperature range indicated by the temperature range information.

In this aspect, it is possible to automatically set the target temperature to be equal to the upper limit or the lower limit of the temperature range indicated by the temperature range information, and thus it is possible to automatically determine the control parameter so as to minimize the consumption power in the temperature range in which the is allowed to live comfortably.

According to an aspect, the air-conditioning control method may further include in a case where it is not detected that the user enters the living room in a period from the target time to a time a predetermined period after the target time, transmitting stop command information to the air-conditioning apparatus via the network to stop the operation of the air-conditioning apparatus.

In this aspect, when a user is not present in his/her living room, it is possible to automatically stop the operation of the air-conditioning apparatus, which allows it to reduce unnecessary power consumption.

The present disclosure may be realized as the air-conditioning control method including the characteristic process described above, but it may also be realized as an air-conditioning control apparatus or the like configured to perform the characteristic process according to the air-conditioning control method. The present disclosure may also be realized as a storage medium storing a computer program that causes a computer to execute the characteristic process according to the air-conditioning control method. In view of the above, in addition to the aspects described above, the present disclosure further provides various aspects described below that allow it to achieve similar effects to those descried above.

According to an aspect, the present disclosure provides an air-conditioning control apparatus connected to an air-conditioning apparatus via a network, the air-conditioning control apparatus including a database storing in-room temperature history information representing a history of an in-room temperature change in a living room whose temperature is adjusted by the air-conditioning apparatus in relation to operation history information representing an operation history of the air-conditioning apparatus, a predictor that predicts, as a predicted off-state in-room temperature, a future in-room temperature of the living room based on the in-room temperature history information and the operation history information for a case where the temperature is not adjusted by the air-conditioning apparatus, and a determiner that determines, based on the predicted off-state in-room temperature, a control parameter of the air-conditioning apparatus, the control parameter being used for the in-room temperature of the living room to reach a target temperature at a target time.

According to an aspect, the present disclosure provides a non-transitory computer-readable storage medium storing a program for causing a computer to execute a process so as to function as an air-conditioning control apparatus connected to an air-conditioning apparatus via a network, the process including storing, in a database, in-room temperature history information representing a history of an in-room temperature change in a living room whose temperature is adjusted by the air-conditioning apparatus in relation to operation history information representing an operation history of the air-conditioning apparatus, predicting, as a predicted off-state in-room temperature, a future in-room temperature of the living room based on the in-room temperature history information and the operation history information for a case where the temperature is not adjusted by the air-conditioning apparatus, and determining, based on the predicted off-state in-room temperature, a control parameter of the air-conditioning apparatus, the control parameter being used for controlling the in-room temperature of the living room to reach a target temperature at a target time.

The computer program may be distributed such that the computer program is stored in a computer-readable non-transitory storage medium such as a CD-ROM disk or the like, and the storage medium is distributed. The computer program may also be distributed via a communication network such as the Internet.

Part of elements of the air-conditioning control apparatus according to one of the embodiments of the present disclosure and the other elements may be implemented on a plurality of computers in a system.

Note that each embodiment described below is for illustrating a specific example of the present disclosure. That is, in the following embodiments of the present disclosure, values, shapes, constituent elements, steps, the order of steps, and the like are described by way of example but not limitation. Among constituent elements described in the following embodiments, those constituent elements that are not described in independent claims indicating highest-level concepts of the present disclosure are optional. Furthermore, two or more embodiments may be combined.

Embodiments

Embodiments of the present disclosure are described below with reference to drawings. FIG. 1 is a block diagram illustrating a configuration of an air-conditioning control system according to a first embodiment of the present disclosure.

In FIG. 1, the air-conditioning control system includes an air-conditioner 10, and a cloud server 20. The cloud server 20 is connected, via a network 30, to the air-conditioner 10, a weather information server 40 and a user device 50. Note that the air-conditioner 10 is an example of an air-conditioning apparatus that adjusts the temperature in a living room used by a user. The cloud server 20 is an example of an air-conditioning control apparatus that control the air-conditioning apparatus. The user device 50 is an example of an information terminal possessed by a user.

The air-conditioner 10 is an apparatus that adjusts an air-conditioning environment in a room, and an example thereof is a room air conditioner. The air-conditioner 10 includes a temperature/humidity information acquisition unit 11, a control information acquisition unit 12, and an air-conditioning controller 13.

The air-conditioning controller 13 is a control mechanism that adjusts the temperature and/or humidity of air in a room, and more specifically, the air-conditioning controller 13 is a controller of an air-conditioning function of an air-conditioner. However, another device may be employed as the air-conditioning controller 13 as long as it functions as a control mechanism capable of controlling the temperature and/or humidity in a room.

The temperature/humidity information acquisition unit 11 acquires, using a temperature/humidity sensor, the temperature and the humidity in a room and the temperature and humidity outside the room. Although in the present embodiment, by way of example, the humidity in the room and the humidity outside the room are also acquired, only the temperature inside the room and the temperature outside the room may be acquired, or other measured values may be acquired.

The control information acquisition unit 12 acquires air-conditioning control information from the air-conditioning controller 13 or the like. The air-conditioning control information is information on a control performed by the air-conditioning controller 13, and more specifically, the air-conditioning control information is information representing an operation status (ON/OFF), an operation mode (cooling/heating/drying/automatic mode), a set temperature, an air flow rate, an air flow direction, and/or the like.

The configuration of the air-conditioner 10 has been described above.

The cloud server 20 includes a temperature/humidity information storage, 21, a control information storage 22, an in-room environment predictor 23, an air conditioning setting unit 24, an interface 25, an environment history database (DB) 26, and an outside environment predictor 27.

The temperature/humidity information storage, 21 stores, in the environment history DB 26, the temperature/humidity information acquired via the temperature/humidity information acquisition unit 11 of the air-conditioner 10. Communication between the temperature/humidity information storage, 21 and the temperature/humidity information acquisition unit 11 is performed using a network 30 which is a communication mean such as the Internet or the like. For example, the temperature/humidity information storage, 21 acquires temperature/humidity information from the temperature/humidity information acquisition unit 11 once every five minutes and stores it in the environment history DB 26. Note that the communication method is not limited to the example described above. Alternatively, for example, the temperature/humidity information acquisition unit 11 may periodically upload information to the temperature/humidity information storage, 21.

The control information storage 22 stores, in the environment history DB 26, air-conditioning control information acquired via the control information acquisition unit 12 of the air-conditioner 10. Communication between the control information storage 22 and the control information acquisition unit 12 is performed using the network 30 which is a communication means such as the Internet or the like. For example, the control information storage 22 acquires air-conditioning control information from the control information acquisition unit 12 once every five minutes and stores it in the environment history DB 26. Note that the communication method is not limited to the example described above. Alternatively, for example, the control information acquisition unit 12 may periodically upload information to the control information storage 22, or in response to an event that a control of the air-conditioner 10 is changed, the control information acquisition unit 12 may periodically upload information to the control information storage 22.

The environment history DB 26 is a database in which the temperature/humidity information and the air-conditioning control information received from the temperature/humidity information storage, 21 and the control information storage 22 are stored. A widely-used database format is a relational DB such as SQL (Structured Query Language) or the like. However, alternatively, other database formats may be employed. For example, a DB called NoSQL may be employed in which data is described based on a simple relationship such as Key-Value type.

FIG. 2 illustrates an example of a table structure of the environment history DB 26. In FIG. 2, ID is identification information uniquely assigned to each record, and time is information indicating a time at which information of interest is acquired. An in-room temperature, an in-room humidity, an outside-room temperature, and an outside-room humidity are temperature/humidity information acquired via the temperature/humidity information acquisition unit 11. An operation status, an operation mode, a set temperature, an air flow rate, and an air flow direction are air-conditioning control information acquired via the control information acquisition unit 12. Although in this example, for simplicity and better understanding, the temperature/humidity information and the air-conditioning control information are described in the same one table, they may be described in different tables and they may be managed separately.

Note that information on the time and the in-room temperature is an example of in-room temperature history information indicating a history of an in-room temperature change in a living room whose temperature is controlled by the air-conditioning apparatus. Information on the time, the operation status, the operation mode, the set temperature, and the air flow rate is an example of operation history information indicating an operation history of the air-conditioning apparatus. Information on the time and the outside-room temperature is an example of outside-room temperature history information indicating a history of a temperature change outside the living room. The information stored in the environment history DB 26 is not limited to the examples described above. For example, the information may include power consumption history information indicating a history of electric power consumption of the air-conditioning apparatus, opening/closing history information indicating a history of opening/closing of a window existing in the living room, and/or the like as described later.

The outer environment predictor 27 receives, from the external weather information server 40 or the like, future and past weather prediction information or the like about weather in an area in which the air-conditioner 10 exists, and the outer environment predictor 27 inputs the received information in the in-room environment predictor 23.

The in-room environment predictor 23 performs machine learning using the environment history DB 26 and predicts a future in-room environment (in terms of an in-room temperature, an in-room humidity, and the like). More specifically, the in-room environment predictor 23 performs machine learning as described below, and, based on the in-room temperature history information, and the operation history information, generates an off-state in-room temperature prediction model for use in predicting a further in-room temperature in the living room for a case where the temperature is not controlled by the air-conditioner 10. Using this off-state in-room temperature prediction model, a future in-room temperature in the living room is predicted as a predicted off-state in-room temperature for the case where the temperature is not controlled by the air-conditioner 10. Based on the predicted off-state in-room temperature, the air conditioning setting unit 24 determines control parameters of the air-conditioner 10 for achieving a target temperature in the in-room temperature in the living room at a target time.

In general, the machine learning includes two phases respectively called a learning phase and an identifying phase. In the learning phase, past history data or the like is input as training data, and data analysis is performed on the input training data to extract a correlation among data. In the next identifying phase, identification data (input parameters for use in prediction) is input, and a predicted value is output based on the data correlation extracted in the learning phase.

In this process, the in-room environment predictor 23 receives, as training data, temperature/humidity information and air-conditioning control information stored in the environment history DB 26, and past weather prediction information acquired via the outer environment predictor 27. The in-room environment predictor 23 also receives, as identification data, a future time, a predicted weather value such as a future weather prediction, and setting information on the air-conditioner.

In the manner described above, the in-room environment predictor 23 predicts environment information (the in-room temperature, the in-room humidity, and the like) at a future time. In the machine learning, to achieve high prediction accuracy, it is important to input proper data as training data and proper data as identification data. Many learning algorithms are available. Examples include linear regression, a neural network, a Bayesian filter, SVM (Support Vector Machine), and the like. In the present disclosure, there is no restriction on the learning algorithm. Cloud services of machine learning are available, and examples of such services are Prediction API provided by Google Inc, Azure ML provided by Microsoft Corporation, etc. In general, these services are easy to use, and thus the in-room environment predictor 23 may use libraries or APIs (Application Program Interfaces) available in such services.

The in-room environment predictor 23 performs learning using, as training data, data stored in the environment history DB 26 and weather information supplied from the outer environment predictor 27, and/or the like. By using air-conditioning control information, which is stored as setting information of the air-conditioner 10 in the environment history DB 26 such as an example shown in FIG. 2, it is possible to find a correlation between the setting of the air-conditioner 10 and the in-room temperature or the weather prediction. By inputting setting information on the air-conditioner 10, as identification data, to the in-room environment predictor 23 as described above, the in-room environment predictor 23 is capable of accurately predicting the in-room temperature for the set condition.

The interface 25 is an external-device interface that accepts an input from the user device 50 used by a user. For example, the interface 25 may be an external-device I/F (WebAPI) that communicates using an http protocol to accept setting information on the air-conditioner 10 of the user. For example, a user downloads an application to the user device 50 such as a smartphone, a tablet device, or the like, and the user determines setting information associated with the air-conditioner 10 using a graphical user interface (GUI) of the application. The user device 50 converts the setting information to data in the format of the http protocol and sends it to the interface 25.

Based on the setting information received via the interface 25, the air conditioning setting unit 24 determines, as a control parameter, a setting pattern (operation pattern) of the air-conditioner 10 while using the in-room environment predictor 23. The air conditioning setting unit 24 transmits control command information, which includes the control parameter determined using the in-room environment predictor 23 and which is for operating the air-conditioner 10 based on the control parameter, to the air-conditioner 10 via the interface 25. Note that the control parameter includes start time information indicating a time at which to start the operation of the air-conditioner 10 and/or operation pattern information indicating the operation pattern according to which to operate the air-conditioner 10.

For example, the interface 25 receives, as the setting information, a return-home time (enter-room time) and a target environment value (for example, a target in-room temperature) from the user device 50, and the air conditioning setting unit 24 predicts a change in in-room temperature in a period until a return-home time using the in-room environment predictor 23. In this case, the prediction is performed in terms of a change in predicted off-state in-room temperature for a case where the air-conditioner 10 is not operated. Based on the change in predicted off-state in-room temperature, the air conditioning setting unit 24 determines an operation pattern of the air-conditioner 10 to such that the target temperature is reached at the return-home time (enter-room time).

In the operation of the air-conditioner, in general, it is known that the smaller the difference between the in-room temperature and the set temperature, the more power is saved. In view of this, using the in-room environment predictor 23, the air conditioning setting unit 24 inputs the set temperature of the air-conditioner 10 as identification data and determines a change in a predicted on-state in-room temperature such that the target temperature is reached at the return-home time, and the air conditioning setting unit 24 determines the operation pattern including the set temperature pattern such that energy saving is achieved.

Figure 3:
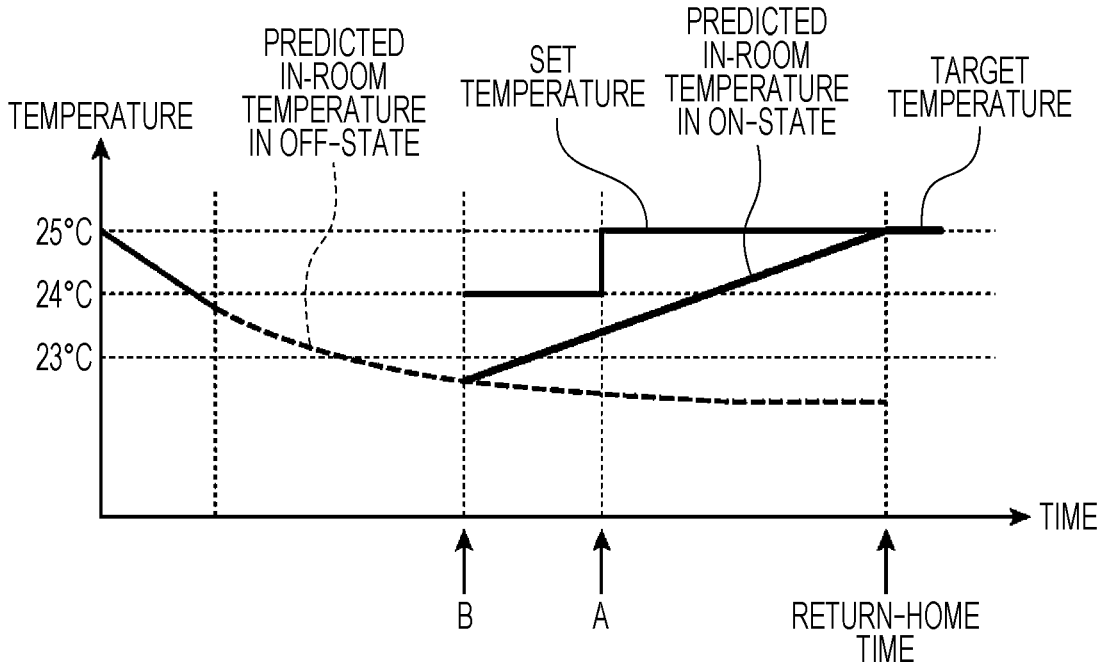
FIG. 3 is a diagram illustrating an example of a set temperature pattern determined by an air conditioning setting unit shown in FIG. 1.

FIG. 3 is a diagram illustrating an example of a set temperature pattern determined by the air conditioning setting unit 24 shown in FIG. 1. In FIG. 3, the target temperature at the return-home time is set, by way of example, to 25° C. In this case, to achieve 25° C. as the in-room temperature at the return-home time, the air conditioning setting unit 24 sets the set temperature to 25° C., and reversely predicts, using the in-room environment predictor 23, the change in the predicted on-state in-room temperature for the case where the temperature is adjusted by the air-conditioner 10. The air conditioning setting unit 24 then determine a time at which the difference between the set temperature and the predicted on-state in-room temperature is equal to 1.5° C. In the example shown in FIG. 3, this time is denoted by A.

Furthermore, the air conditioning setting unit 24 reduces the set temperature by 1° C. at the time A, and further reversely predicts the change in the predicted on-state in-room temperature. The air conditioning setting unit 24 then determines an intersection B between the predicted on-state in-room temperature and the predicted off-state in-room temperature for the case where the temperature is not adjusted by the air-conditioner 10, and the air conditioning setting unit 24 employs the time B as an operation start time of the air-conditioner 10.

The air conditioning setting unit 24 determines the operation pattern including the set temperature pattern of the air-conditioner 10 in the above-described manner, and the air conditioning setting unit 24 controls the air-conditioner 10 according to the determined operation pattern. More specifically, the air conditioning setting unit 24 outputs a control command (control command information) for the operation according to the determined operation pattern to the air-conditioning controller 13 of the air-conditioner 10 thereby controlling the air-conditioner 10.

The timing of outputting the control command information may be an arbitrary time before the operation start time. For example, when the operation start time is reached, the air conditioning setting unit 24 may transmit the control command information. Alternatively, a list of operation start times and control command information may be transmitted, in advance, to the air-conditioning controller 13 such that when each operation start time is reached, the air-conditioning controller 13 performs a corresponding control.

In the example described above, the air conditioning setting unit 24 reversely predicts, using the in-room environment predictor 23, the change in the predicted on-state in-room temperature for the case where the temperature is adjusted by the air-conditioner 10. However, the method of predicting the predicted on-state in-room temperature is not limited to above-described example. For example, in an alternative method, the predicted on-state in-room temperature may be predicted as follows.

That is, in the alternative method, the in-room environment predictor 23 generates an off-state in-room temperature prediction model using the machine learning described above based on the in-room temperature history information and the operation history information thereby obtaining the off-state in-room temperature prediction model for predicting the further in-room temperature of the living room for the case where the temperature is not adjusted by the air-conditioner 10. The in-room environment predictor 23 predicts, using the off-state in-room temperature prediction model, the predicted off-state in-room temperature in terms of the future in-room temperature of the living room for the case where the temperature is not adjusted by the air-conditioner 10, and the in-room environment predictor 23 generates an on-state in-room temperature prediction model for predicting the future in-room temperature of the living room for the case where the temperature is adjusted by the air-conditioner 10. Using this on-state in-room temperature prediction model, the in-room environment predictor 23 predicts, as the predicted on-state in-room temperature, the future in-room temperature of the living room for the case where the temperature is adjusted by the air-conditioner 10. The air conditioning setting unit 24 determines control parameters of the air-conditioner 10 based on the predicted off-state in-room temperature and the predicted on-state in-room temperature.

Even when a change occurs in the environment of the living room such as aging degradation in the house or the air-conditioner 10, it is possible to achieve high accuracy in the prediction of the in-room temperature in both situations in which the air-conditioner 10 is operated and not operated. Thus, it is possible to control the air-conditioner 10 depending on the target temperature and the target time specified by a user while achieving a more reduction in the consumption power such that a more comfortable environment is provided to a user.

The configuration of the air-conditioning control system according to the present embodiment has been described above.

Next, an air-conditioning control process performed in the air-conditioning control system according to the present embodiment is described below. The air-conditioning control process in the air-conditioning control system according to the present embodiment includes two sub-processes. One is a data accumulation process and the other is an air-conditioning setting process.

Figure 4:
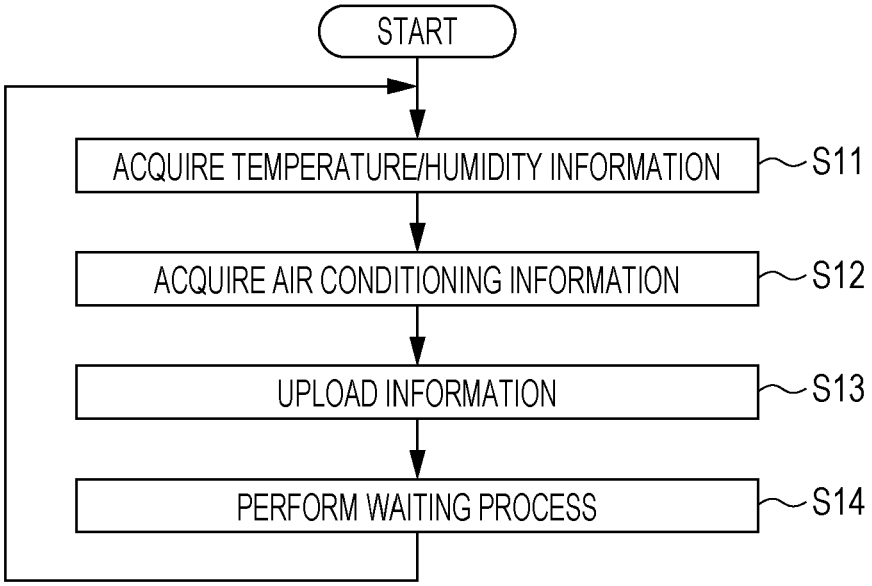
FIG. 4 is a flow chart illustrating an example of a data accumulation process performed in the air-conditioning control system shown in FIG. 1.

FIG. 4 is a flow chart illustrating an example of a data accumulation process performed in the air-conditioning control system shown in FIG. 1.

First, in step S11, the air-conditioner 10 acquires temperature/humidity information detected by a temperature/humidity sensor via the temperature/humidity information acquisition unit 11.

Next, in step S12, the air-conditioner 10 acquires air-conditioning control information associated with the air-conditioner 10 via the control information acquisition unit 12.

Next, in step S13, the temperature/humidity information acquisition unit 11 and the control information acquisition unit 12 of the air-conditioner 10 transmit the temperature/humidity information acquired in step S11 and the air-conditioning control information acquired in step S12 to the cloud server 20. In the cloud server 20, the temperature/humidity information storage, 21 and the control information storage 22 respectively receive the temperature/humidity information and the air-conditioning control information, and register the received information in the environment history DB 26.

Next, in step S14, the air-conditioner 10 performs a waiting process (for example, for 5 minutes). Thereafter, the processing flow returns to step S11 and the process is repeated from step S11.

Figure 5:
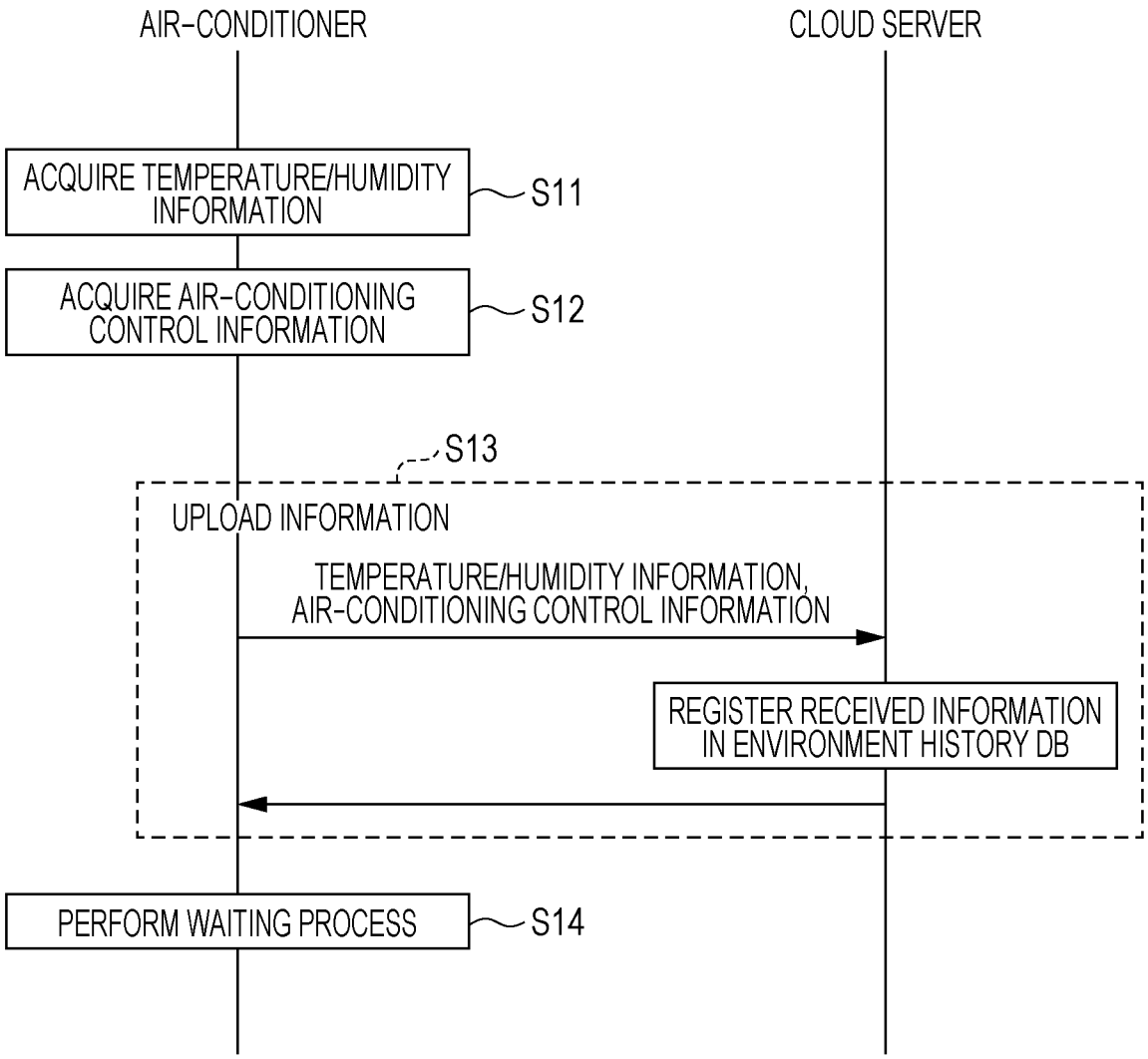
FIG. 5 is a diagram illustrating an example of a process sequence in terms of a data accumulation process shown in FIG. 4 performed by an air-conditioner and a cloud server.

FIG. 5 is a diagram illustrating an example of a process sequence in terms of a data accumulation process shown in FIG. 4 performed by the air-conditioner 10 and the cloud server 20. As illustrated in FIG. 5, the air-conditioner 10 performs the temperature/humidity information acquisition process in step S11 and the air-conditioning control information acquisition process in step S12. In step S13, data transmission is performed between the air-conditioner 10 and the cloud server 20. Thereafter, the air-conditioner 10 performs the waiting process in step S14. The sequence returns to step S11 and the process is repeated from step S11.

The data accumulation process is always performed as long as the communication path between the air-conditioner 10 and the cloud server 20 is established and the power is in the ON-state. The temperature/humidity information and the air-conditioning control information are all registered in the environment history DB 26 in the above-described manner. Although in the example shown in FIG. 4, the temperature/humidity information acquisition process and the air-conditioning control information acquisition process are performed sequentially, they may be performed in parallel. Instead of periodically performing the air-conditioning control information acquisition process, uploading to the cloud server 20 may be performed when a change occurs in control of the air-conditioner 10.

The data accumulation process has been described above.

Figure 6:
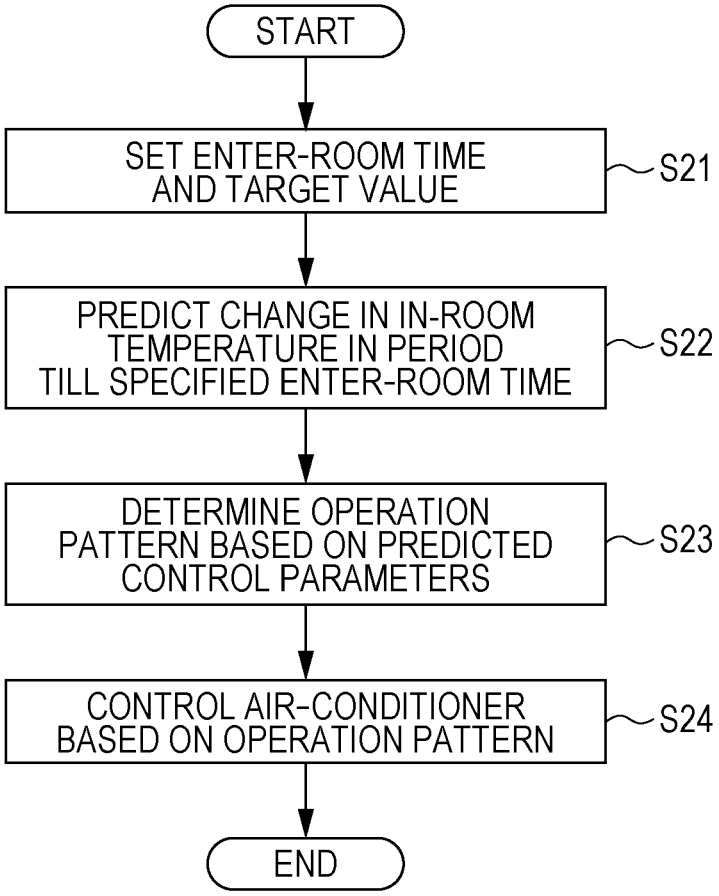
FIG. 6 is a flow chart illustrating an example of an air-conditioning setting process performed in the air-conditioning control system shown in FIG. 1.

Next, the air-conditioning setting process is described. FIG. 6 is a flow chart illustrating an example of the air-conditioning setting process performed in the air-conditioning control system shown in FIG. 1, and FIG. 7 is a diagram illustrating an example of a setting screen and a graph of a change in in-room temperature used in the air-conditioning setting process shown in FIG. 6.

Figure 7:
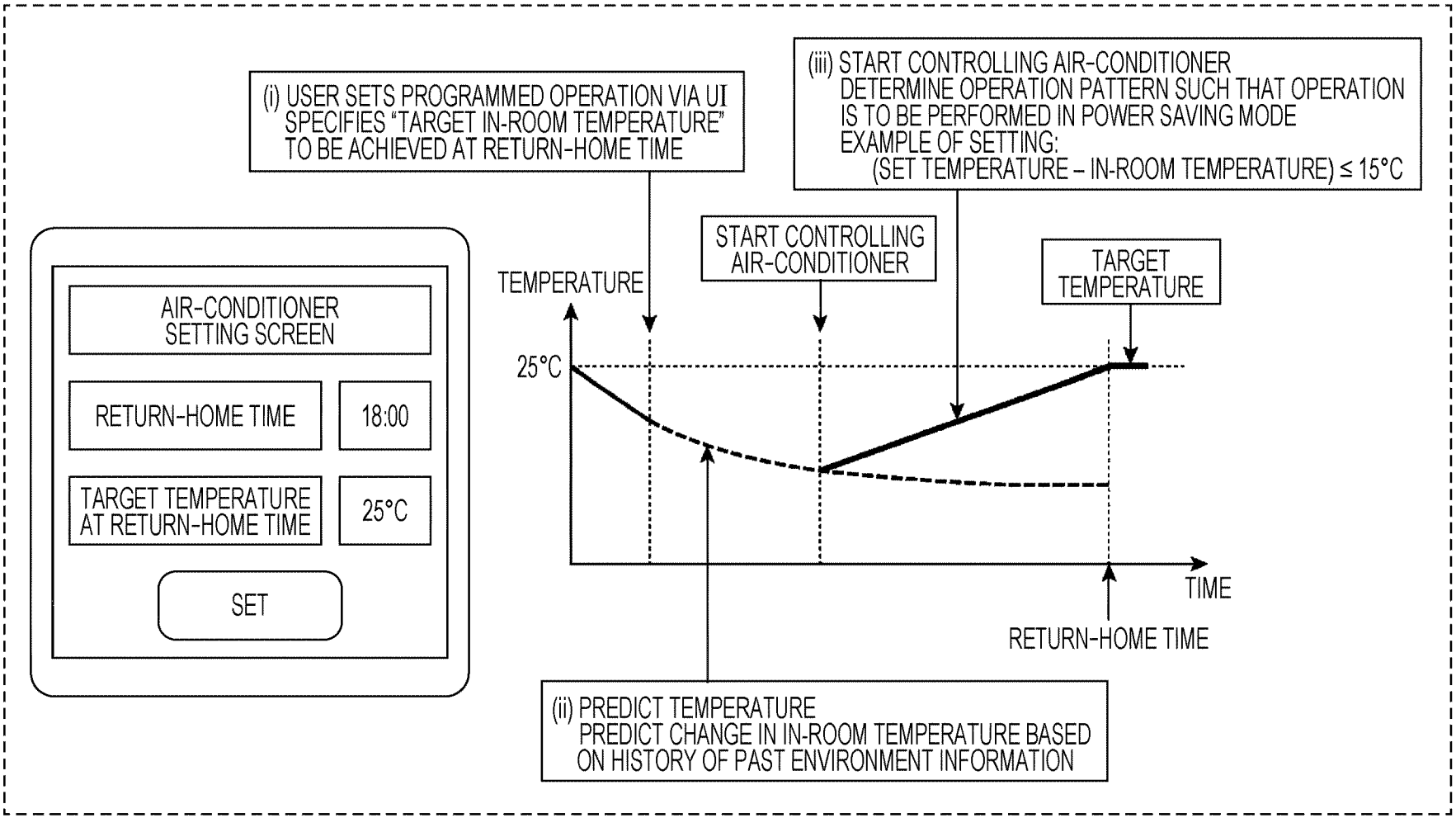
FIG. 7 is a diagram illustrating an example of a setting screen and an in-room temperature change graph used in the air-conditioning setting process shown in FIG. 6.

Referring to FIG. 6 and FIG. 7, the air-conditioning setting process is described below. A setting screen shown on a left-hand side of FIG. 7 is an example of a GUI application for use by a user to determine setting information on the air-conditioner 10. A graph shown on a right-hand side of FIG. 7 illustrates a change in temperature inside a room.

First, a user inputs a return-home time (enter-room time) and a target temperature at the return-home time (target value) to the user device 50 using the setting screen on the left-hand side of FIG. 7 ((i) in FIG. 7). In response, in step S21, the user device 50 sends data indicating the values input by the user (for example, 18:00 as the return-home time, 25° C. as the target temperature at the return-home time), as the enter-room time and the target value, to the interface 25.

Next, in step S22, based on the setting information (the enter-room time and the target value) acquired via the interface 25, the air conditioning setting unit 24 predicts a change in the predicted on-state in-room temperature in a period until the return-home time using the in-room environment predictor 23. In the graph on the right-hand side of FIG. 7, a dotted line indicates a change in in-room temperature predicted based on the history information stored in the environment history DB 26 ((ii) in FIG. 7). Note that these predicted values are in terms of the change in in-room temperature (predicted off-state in-room temperature) in the state in which the air-conditioner 10 is not operated.

Next, in step S23, based on the change in the predicted on-state in-room temperature predicted in step S22, the air conditioning setting unit 24 determines the operation pattern of the air-conditioner 10 such that the target temperature is reached at the return-home time. In the operation of the air-conditioner, in general, it is known that the smaller the difference between the in-room temperature and the set temperature, the more power is saved. In view of this, using the in-room environment predictor 23, the air conditioning setting unit 24 inputs the set temperature of the air-conditioner 10 shown in FIG. 3 as identification data and determines the predicted on-state in-room temperature such that the target temperature is reached at the return-home time.

In FIG. 3, the target temperature at the return-home time is set, by way of example, to 25° C. To achieve 25° C. as the in-room temperature at the return-home time, the air conditioning setting unit 24 sets the set temperature to 25° C. and reversely predicts the change in the predicted on-state in-room temperature by using the in-room environment predictor 23. The air conditioning setting unit 24 then determines a time at which the difference between the set temperature and the predicted on-state in-room temperature is equal to 1.5° C. This time is denoted as time A in FIG. 3.

Next, the air conditioning setting unit 24 reduces the set temperature by 1° C. at the time A, and reversely predicts the change in predicted on-state in-room temperature. The air conditioning setting unit 24 then determines an intersection B at between the predicted on-state in-room temperature and the predicted off-state in-room temperature for the case where the adjustment of temperature by the air-conditioner 10 is not performed, and the air conditioning setting unit 24 sets the operation start time of the air-conditioner 10 at time B. The air conditioning setting unit 24 determines the operation pattern of the air-conditioner 10 in the above-described manner. In the graph on the right-hand side of FIG. 7, a thick line represents a change in the predicted on-state in-room temperature predicted from the history information stored in the environment history DB 26 ((iii) in FIG. 7).

Next, in step S24, the air conditioning setting unit 24 controls the air-conditioner 10 according to the determined operation pattern. Thereafter, the process is ended. More specifically, the air conditioning setting unit 24 outputs a control command (control command information) for the operation according to the operation pattern described above thereby controlling the air-conditioner 10.

Figure 8:
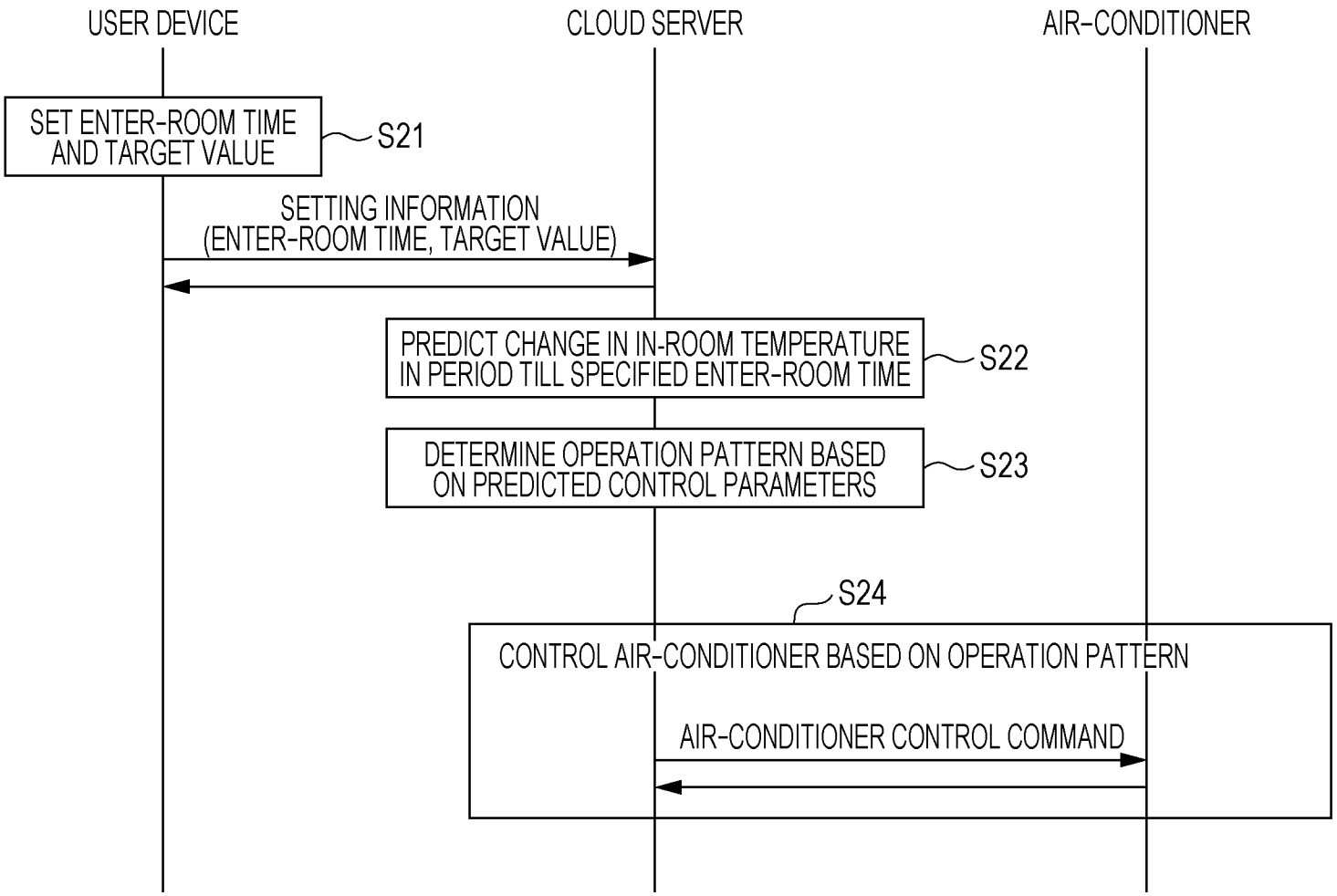
FIG. 8 is a diagram illustrating an example of a process sequence performed by a user device, a cloud server, and an air-conditioner in the air-conditioning setting process shown in FIG. 6.

FIG. 8 is a diagram illustrating an example of a process sequence performed by the user device 50, the cloud server 20, and the air-conditioner 10 in the air-conditioning setting process shown in FIG. 6. As illustrated in FIG. 8, in step S21, the user device 50 operated by a user transmits the setting information (the enter-room time and the target value) to the cloud server 20. In step S22, based on the setting information (the enter-room time and the target value) acquired via the interface 25, the cloud server 20 predicts a change in the predicted on-state in-room temperature in a period until the return-home time using the in-room environment predictor 23. In step S23, based on the predicted change in the predicted on-state in-room temperature, the cloud server 20 determines the operation pattern such that the target temperature is reached at the return-home time. In step S24, the cloud server 20 controls the air-conditioner 10 according to the operation pattern. In this process, to control the air-conditioner 10, the cloud server 20 transmits an air-conditioner control command (control command information) in a data format according to the ECHONET Lite standard or the like.

The air-conditioning setting process has been described above.

Figure 9:
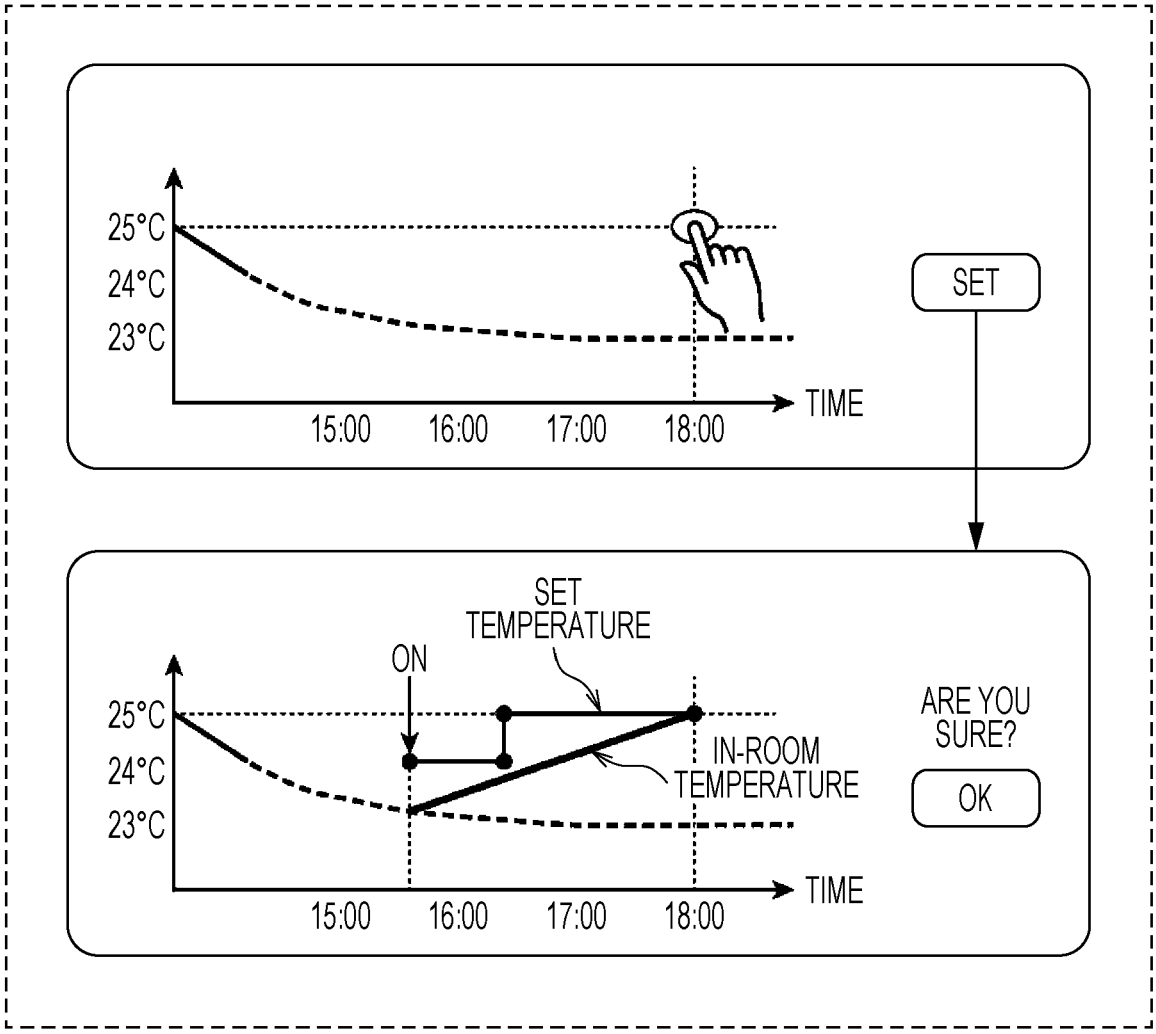
FIG. 9 is a diagram illustrating an example of a user interface for use in air-conditioning setting by a user device shown in FIG. 1.

FIG. 9 illustrates an alternative example of a GUI for use by a user to specify setting of the air-conditioner 10. That is, FIG. 9 illustrates an example of a user interface provided on the user device 50 shown in FIG. 1 for setting air-conditioning.

In an upper area of FIG. 9, a GUI screen is shown which is for use by a user in set the return-home time (enter-room time) and the target temperature at the return-home time. In this GUI screen, a vertical axis represents temperature and horizontal axis represents time. The user device 50 has a display unit (not shown) on whose screen a graph representing a change in in-room temperature predicted by the in-room environment predictor 23 is displayed. A user is allowed to easily specify the target temperature and the return-home time by tapping a point on the graph displayed on the display unit.

By displaying the predicted change in in-room temperature in a manner that allows a user to easily understand it as described above thereby presenting information based on which the user is allowed to determine the target temperature, the user is allowed to easily set the target temperature and the return-home time.

When the user sets the target temperature and the return-home time, information may be displayed as shown in a lower area of FIG. 9. That is, the information displayed in the lower area of FIG. 9 may include the set temperature, an in-room temperature (predicted on-state in-room temperature) predicted for the case where the air-conditioner 10 is operated with this set temperature, and the operation start time denoted by "ON". Thus, the user can easily understand the content of the setting on the air-conditioner 10, the starting time of the operation of the air-conditioner 10, and the predicated temperature change resulting from the setting on the air-conditioner 10.

The environment history DB 26 may be configured such that the electric power consumption per unit time of the air-conditioner 10 is stored, and it may be used as training data for the in-room environment predictor 23. This makes it possible for the air conditioning setting unit 24 to make a determination, using the in-room environment predictor 23 and based on the relationship among the set temperature, the in-room temperature, the outside temperature, and the electric power consumption, as to the control method such that the electric power consumption of the air-conditioner 10 is minimized.

More specifically, for example, using the in-room environment predictor 23, the air conditioning setting unit 24 prepares two or more candidates for the set temperature pattern and determines the predicted electric power consumption of the air-conditioner 10 for a case where each candidate for the set temperature pattern is input as identification data to the in-room environment predictor 23. By employing an operation pattern that results in minimum electric power consumption, it is possible to operate the air-conditioner 10 with low electric power consumption.

After the set temperature pattern is determined as shown in the lower area of FIG. 9, an electricity expense predicted based on the electric power consumption may be displayed such that a user is allowed to get to know the predicted electricity expense before payment. The electric power consumption may be measured by the air-conditioner 10 or may be measured at an outlet through which power is supplied to the air-conditioner 10.

The method of determining control parameters of the air-conditioner 10 taking into account the electric power consumption is described in further detail below.

The control information acquisition unit 12 acquires electric power consumption per unit time of the air-conditioner 10 as air-conditioning control information from the air-conditioning controller 13 or the like. The control information storage 22 stores the air-conditioning control information including the information on the electric power consumption in the environment history DB 26. The environment history DB 26 stores the electric power consumption per unit time of the air-conditioner 10 as the consumption power history information representing the history of the electric power consumption of the air-conditioner 10.

The in-room environment predictor 23 generates an off-state in-room temperature prediction model for use in predicting a future in-room temperature of a living room for the case where the temperature is not controlled by the air-conditioner 10 by using the machine learning based on the in-room temperature history information the operation history information, and the power consumption history information. Using this off-state in-room temperature prediction model, the in-room environment predictor 23 predicts the future in-room temperature of the living room for the case where the temperature is not controlled by the air-conditioner 10, and the in-room environment predictor 23 generates an on-state in-room temperature prediction model for use in predicting the future in-room temperature of the living room for a case where the temperature is controlled by the air-conditioner 10. Using this on-state in-room temperature prediction model, the in-room environment predictor 23 predicts the future in-room temperature of the living room for the case where the temperature is controlled by the air-conditioner 10, and the in-room environment predictor 23 generates an on-state electric power consumption prediction model for use in predicting the future electric power consumption of the air-conditioner 10 for the case where the temperature is controlled by the air-conditioner 10. Using this on-state electric power consumption prediction model, the in-room environment predictor 23 predicts, as the predicted on-state electric power consumption, the future consumption power of the air-conditioner 10 for the case where the temperature is controlled by the air-conditioner 10.

The air conditioning setting unit 24 determines control parameters of the air-conditioner 10 based on the predicted off-state in-room temperature, the predicted on-state in-room temperature, and the predicted on-state electric power consumption.

Even when a change occurs in the environment of the living room such as aging degradation in the house or the air-conditioner 10, it is possible to achieve high accuracy in the prediction of the in-room temperature in both situations in which the air-conditioner 10 is operated and not operated and it is also possible to achieve high accuracy in the prediction of the electric power consumption in the situation in which air-conditioner 10 is operated. Thus, it is possible to control the air-conditioner 10 depending on the target temperature and the target time specified by a user while achieving a more reduction in the consumption power such that a more comfortable environment is provided to a user.

Figure 10:
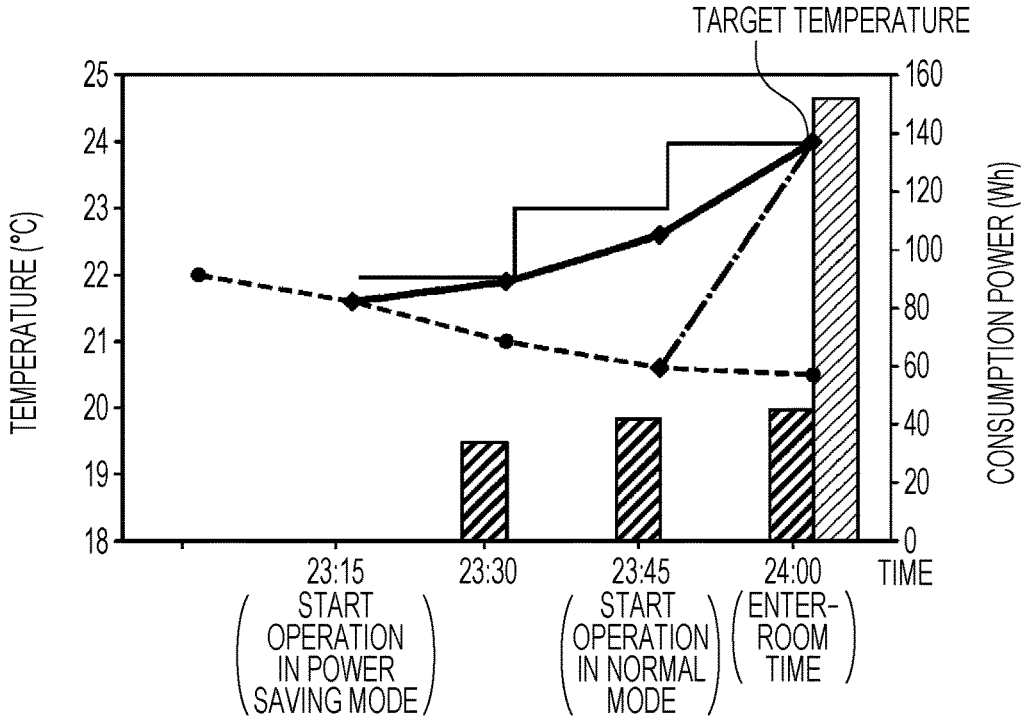
FIG. 10 is a diagram illustrating another example of a set temperature pattern determined by the air conditioning setting unit shown in FIG. 1.

FIG. 10 is a diagram illustrating an example of a set temperature pattern determined by the air conditioning setting unit 24 taking into account the electric power consumption described above. In the example shown in FIG. 10, the air conditioning setting unit 24 determines the predicted off-state in-room temperature, the predicted on-state in-room temperature, and the predicted on-state electric power consumption for each of a plurality of operation patterns using the in-room environment predictor 23. The air conditioning setting unit 24 detects an operation pattern that is the lowest in electric power consumption among all operation patterns and employs the detected operation pattern as an energy-saving operation pattern.

In FIG. 10, a dotted line represents an example of a predicted off-state in-room temperature. A stepwise thin line represents an example of a set temperature of the energy-saving operation pattern selected as the set temperature pattern (22° C. at a point of time 45 minutes before the enter-room time, 23° C. at a point of time 30 minutes before, and 24° C. at a point of time 15 minutes before). That is, the controlling of the air-conditioner 10 is started 45 minutes before the enter-room time according to the energy-saving operation pattern. In FIG. 10, a thick solid line represents a predicted on-state in-room temperature predicted according to the energy-saving operation pattern. A bar graph hatched with thick lines represents electric power consumption at respective times.

In FIG. 10, a dash-dot line represents, as a comparative example, a predicted on-state in-room temperature for a case where a normal operation pattern (the set temperature (target temperature) is 24° C. and the control is started 15 minutes before the enter-room time) is employed. A bar graph hatched with thin lines represents electric power consumption for the case where the normal operation pattern is employed.

As shown in FIG. 10, the total electric power consumption is smaller in the energy-saving operation pattern than in the normal operation pattern, and a peak value of the electric power consumption in each 15-minute period is also smaller in the energy-saving operation pattern than in the normal operation pattern. That is, the air-conditioner 10 is controlled according to the energy-saving operation pattern determined by the air conditioning setting unit 24, using the in-room environment predictor 23, from a plurality of operation patterns in the above-described manner, and thus it is possible to further reduce the electric power consumption of the air-conditioner 10.

Figure 11:
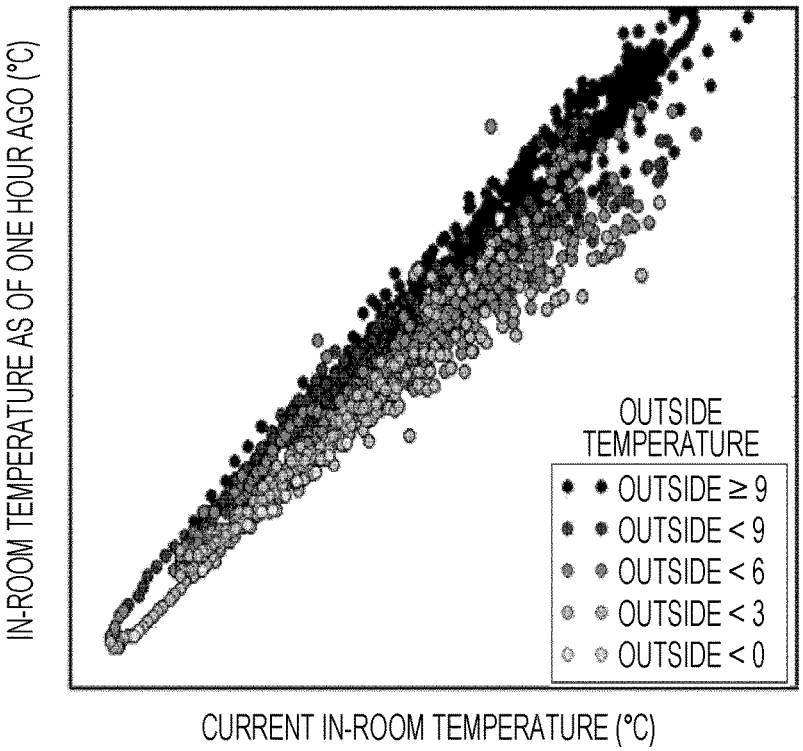
FIG. 11 is a diagram illustrating a first example of a result of data analysis performed by an in-room environment predictor shown in FIG. 1.
Figure 12:
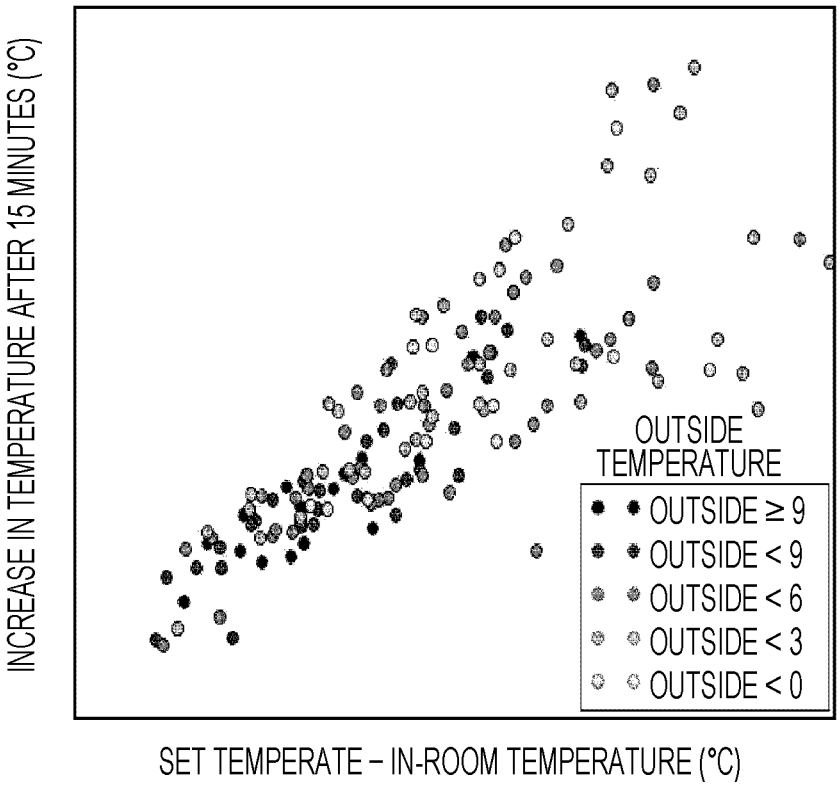
FIG. 12 is a diagram illustrating a second example of a result of data analysis performed by the in-room environment predictor shown in FIG. 1.
Figure 13:
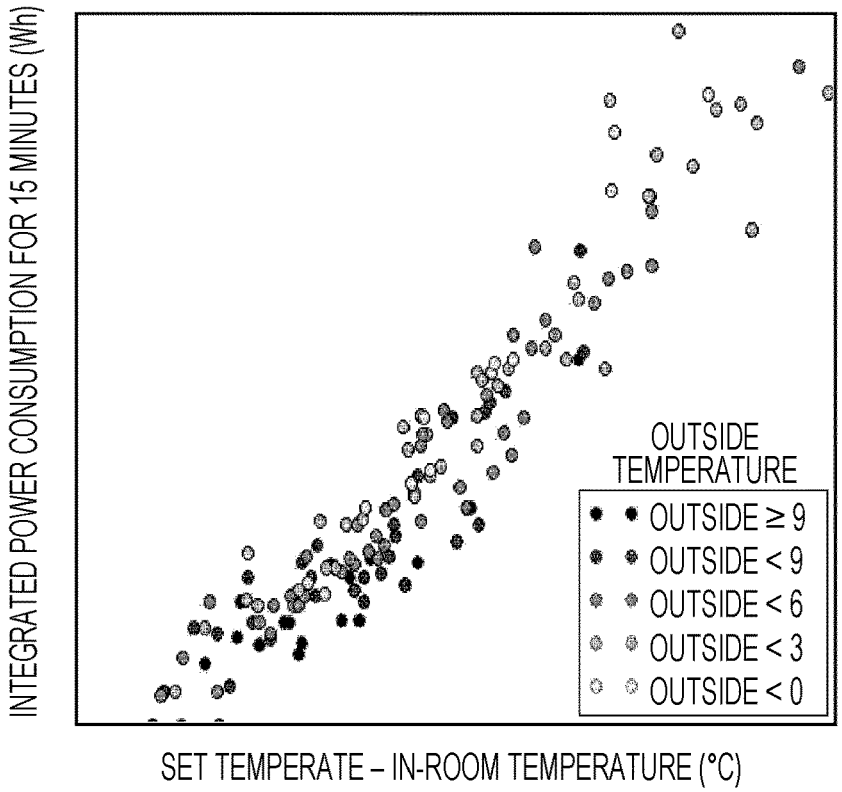
FIG. 13 is a diagram illustrating a third example of a result of data analysis performed by the in-room environment predictor shown in FIG. 1.

Next, results of data analysis in machine learning by the in-room environment predictor 23 are described below. FIG. 11 to FIG. 13 respectively illustrate first to third examples of results of data analysis by the in-room environment predictor 23 shown in FIG. 1.

In the example shown in FIG. 11, a linear regression model is used as the off-state in-room temperature prediction model where the in-room temperature as of one hour ago, the outside temperature, and the time are used as learning parameters. More specifically, this model is obtained as a result of analysis on the correlation between the current temperature and the in-room temperature as of one hour ago and the outside temperature. In this example, the correlation coefficient between the current in-room temperature and the in-room temperature as of one hour ago is 0.969, while the correlation coefficient between the current in-room temperature and the outside temperature is 0.724. In general, when the correlation coefficient is in a range from 0.4 to 0.7, there is a correlation. When the correlation coefficient is equal to or greater than 0.7, there is a strong correlation. Thus, by using, as the off-state in-room temperature prediction model, the linear regression model in which the in-room temperature as of one hour ago, the outside temperature, and the time are used as learning parameters, it is possible to accurately determine the predicted off-state in-room temperature.

In the example shown in FIG. 12, as the on-state in-room temperature prediction model, a linear regression model is used in which the set temperature, the in-room temperature, and the time is used as learning parameters. More specifically, this model is obtained as a result of analysis on the increase in temperature after 15 minutes, the outside temperature, the difference between the set temperature and the in-room temperature, and the outside temperature. In this example, the correlation coefficient between the increase in temperature after 15 minutes and the outside temperature is 0.373, while the correlation coefficient between the increase in temperature after 15 minutes and the difference between the set temperature and the in-room temperature is 0.812. Thus, by using, as the on-state in-room temperature prediction model, the linear regression model in which the set temperature, the in-room temperature, and the time are used as learning parameters, it is possible to accurately determine the predicted on-state in-room temperature.

In the example shown in FIG. 13, as the on-state electric power consumption prediction model, a linear regression model is used in which the set temperature, the in-room temperature, the outside temperature, and the time are used as learning parameter. More specifically, this model is obtained as a result of analysis on the correlation among the 15-minute integral power consumption, the outside temperature, and the difference between the set temperature and the in-room temperature. In this example, the correlation coefficient between the 15-minute integral power consumption and the outside temperature is 0.463, while the correlation coefficient between the set temperature in terms of the 15-minute integral power consumption and the in-room temperature is 0.950. Thus, by using, as the on-state electric power consumption prediction model, the linear regression model in which the set temperature, the in-room temperature, the outside temperature, and the time are used as learning parameters, it is possible to accurately determine the predicted on-state electric power consumption.

Figure 14:
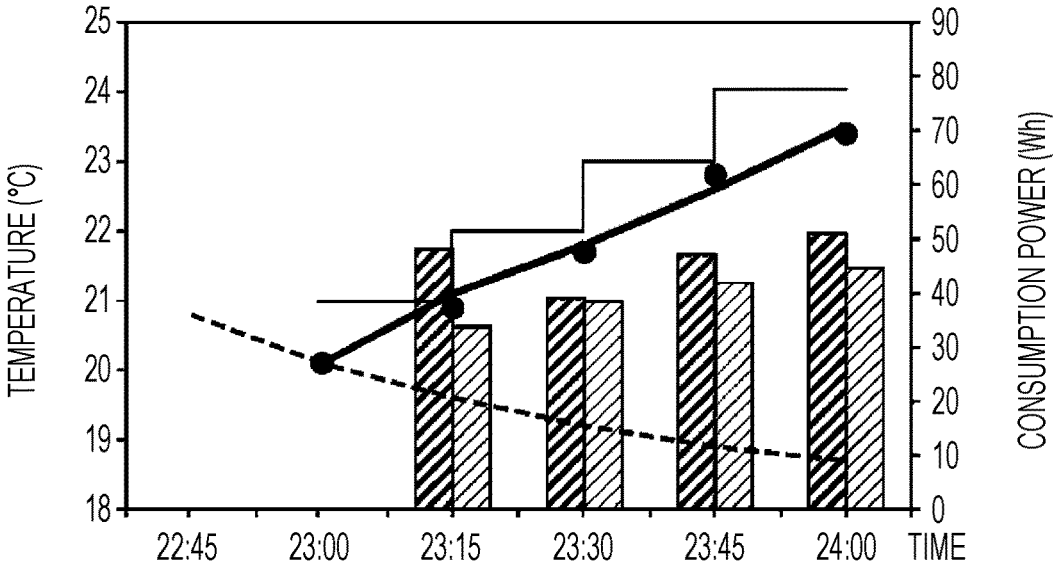
FIG. 14 is a diagram illustrating an example of prediction accuracy of a predicted on-state in-room temperature with respect to a set temperature pattern determined by the air conditioning setting unit shown in FIG. 1, and prediction accuracy of a predicted on-state electric power consumption.

Next, prediction accuracy is described for a case where the predicted on-state in-room temperature and the predicted on-state electric power consumption are determined by in-room environment predictor 23 via machine learning using the off-state in-room temperature prediction model, the on-state in-room temperature prediction model, and the on-state electric power consumption prediction model described above. FIG. 14 is a diagram illustrating an example of prediction accuracy of the predicted on-state in-room temperature and the predicted on-state electric power consumption when the set temperature pattern is determined by the air conditioning setting unit 24 shown in FIG. 1.

For example, in a case where the return-home time is set to 24:00 and the target temperature is set to 24° C., the in-room environment predictor 23 determines the predicted off-state in-room temperature, the predicted on-state in-room temperature, and the predicted on-state electric power consumption using the respective linear regression models described above with reference to FIG. 11 to FIG. 13 for each of a plurality of operation patterns. The air conditioning setting unit 24 selects an operation pattern that provides a lowest electric power consumption, and employs it as the energy-saving operation pattern.

In the example shown in FIG. 14, a measured on-state in-room temperature and a measured on-state electric power consumption are shown which were measured in a state in which the air-conditioner 10 was actually controlled according to a set temperature pattern of the determined energy-saving operation pattern, and a predicted on-state in-room temperature and a predicted on-state electric power consumption are also shown which were predicted by the in-room environment predictor 23.

In FIG. 14, a stepwise thin line represents a set temperature according to the energy-saving operation pattern (21° C. as of 60 minutes before the enter-room time, 22° C. as of 45 minutes before, 23° C. as of 30 minutes before, and 24° C. as of 15 minutes before, which is equal to the target temperature). The actual controlling of the air-conditioner 10 is started 60 minutes before the enter-room time according to the energy-saving operation pattern.

In this situation, a thick solid line in FIG. 14 represents, as the predicted value, the predicted on-state in-room temperature, and a bar graph hatched with thick lines represents predicted on-state electric power consumption at respective times. In FIG. 14, solid circles indicate measured values in terms of the measured on-state in-room temperature, and a bar graph hatched with thin lines represents measured on-state electric power consumption at respective times.

As shown in FIG. 14, the predicted on-state in-room temperature shows a good agreement with the measured on-state in-room temperature, and the predicted on-state electric power consumption shows a good agreement with the measured on-state electric power consumption. For example, in a case where the average of the predicated values and the average of the measured values are determined respectively twelve times, the average change in the in-room temperature in 60 minutes was +3.2° C. for the predicted on-state in-room temperature and +3.6° C. for the measured on-state in-room temperature, and thus the error of the predicted value with respect to the measured value was 0.4° C. Regarding the total electric power consumption, the predicted on-state electric power consumption was 206.6 Wh while the measured on-state electric power consumption was 196.0 Wh, and thus the error of the predicted value with respect to the measured value was 5.1%.

As described above, the in-room environment predictor 23 is capable of determining the predicted on-state in-room temperature and the predicted on-state electric power consumption using the respective linear regression models described above with reference to FIG. 11 to FIG. 13.

Figure 15:
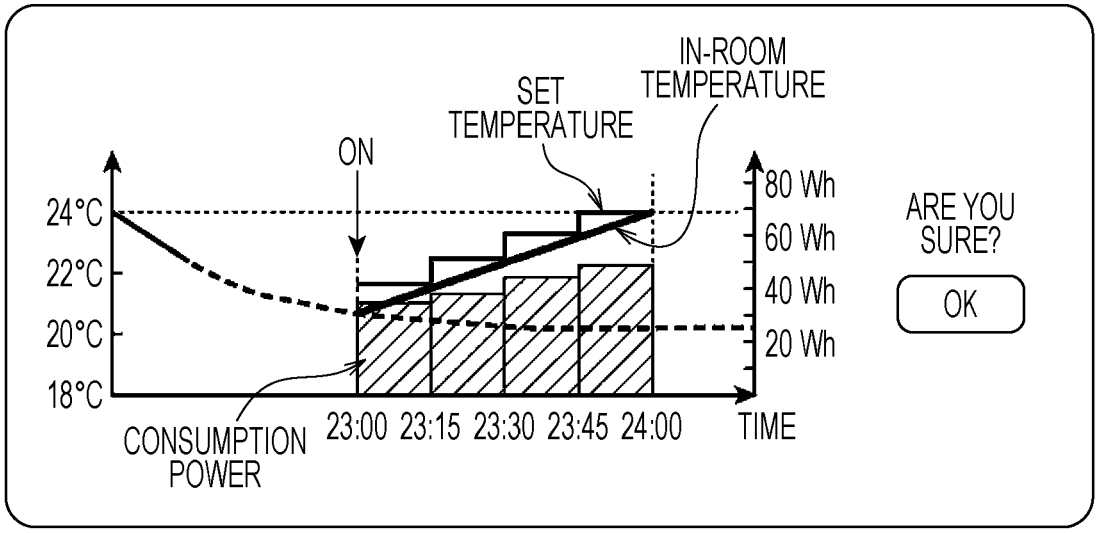
FIG. 15 is a diagram illustrating an example of a user interface for use in air-conditioning setting in the user device shown in FIG. 1 for a case where electric power consumption is taken into account.

Next, a user interface for air-conditioning setting in the user device 50 taking into account the electric power consumption is described. FIG. 15 is a diagram illustrating an example of a user interface for use in air-conditioning setting in the user device 50 shown in FIG. 1 for the case where electric power consumption is taken into account.

For example, in a case where the return-home time of a user is set to 24:00 and the target temperature at the return-home time is set to 24° C. using a GUI screen such as that shown in the upper area of FIG. 9, a GUI screen such as that shown in FIG. 15 is displayed on the display unit of the user device 50. In the example shown in FIG. 15, shown are the set temperature of the energy-saving operation pattern determined by the air conditioning setting unit 24, the in-room temperature (predicted on-state in-room temperature) predicted by the in-room environment predictor 23 for the case where the air-conditioner 10 is operated with the set temperature, and the electric power consumption (predicted on-state electric power consumption) represented in the form of a graph.

By providing information in the above-described manner, it is possible to present not only the predicted change in in-room temperature but also the predicted change in electric power consumption in an easily understandable manner thereby presenting information based on which a user is allowed to determine the target temperature taking into account the energy saving. Thus, it becomes possible for a user to easily set the target temperature and the return-home time taking into account the energy saving.

In the case where the air-conditioner 10 is a room air conditioner, to control the air-conditioner 10 in an efficient manner in a period until the user enters his/her room, it is desirable to increase the air flow rate such that the air is circulated in the room in which no one is present. That is, in the period until the enter-room time, the air-conditioning may be controlled such that the air flow rate is set to be strong, and the air flow direction is set to be horizontal in the case of cooling and downward in the case of heating. In general, the strong air flow may cause a person to feel uncomfortable. However, when no one is present in the room, the air flow may be set to be strong. The determination as to whether there is someone in the room may be performed by the user or, more accurately and more efficiently, by using a human sensor or the like. After the user enters the room, the air flow rate may be automatically set to be low.

In the above-described example according to the present embodiment, the return-home time (enter-room time) is specified using the GUI. However, alternatively, the return-home time (enter-room time) may be specified such that machine learning is performed in terms of the enter-room time and the leave-room time using the history data of the enter-room time and the leave-room time detected by a human sensor or GPS (Global Positioning System), and the enter-room time and the leave-room time are predicted. As for training data, history data may be input as to the day of week, the time, the human sensor, and the GPS, and the enter-room or leave-room time of a particular day may be predicted using identification data of the current GPS position information, the day of week, and the time.

For example, the environment history DB 26 may store at least one of enter-room history information representing enter-room history and leave-room history information representing leave-room history. Based on at least one of the enter-room history information and the leave-room history information, the in-room environment predictor 23 may estimate the usage time at which the living room is used by the user, and the air conditioning setting unit 24 may employ the estimated usage time as the target time.

The interface 25 may receive, via the network 30, a result of detection performed by a human sensor disposed in the living room as to whether a user is present in the living room, and, depending on the result of the detection performed by the human sensor, at least one of the enter-room history information and the leave-room history information stored in the environment history DB 26 may be updated.

Alternatively, the interface 25 may receive, via the network 30, GPS information on the user device 50 possessed by a user, and may determine at least one of the user entering the living room and leaving the living room based on the GPS information received from the user device 50. Based on the at least one of the entering the room and the leaving the room determined, the interface 25 may update at least one of the enter-room history information and the leave-room history information stored in the environment history DB 26.

In a case where it is not detected that the user enters the living room in a period until the target time, the air conditioning setting unit 24 may transmit stop command information to the air-conditioner 10 via the network 30 to stop the operation of the air-conditioner 10.

In the above-described example according to the present embodiment, a target value at a return-home time (enter-room time) is set, and an operation pattern is determined such that the target value is expected to be reached at the return-home time (enter-room time). However, alternatively, setting may be performed for a target value which is expected to be reached at a particular time in a state where a user has already entered a room, and control may be performed to achieve the target value at this particular time.

For example, in a period in which a user is asleep, it may be desirable that after the user gets to sleep, the temperature is gradually increased taking into account the circadian rhythm. In view of the above, for example, in a case where a user is to go to bed at 11:00 p.m., target values may be set to 25° C. at 11:00 p.m., 26° C. at 2:00 a.m., and 27° C. at 5:00 a.m., respectively, and the air conditioning setting unit 24 may determine, using the in-room environment predictor 23, an operation pattern such that the respective target temperatures are reached at the corresponding target times. This makes it possible to achieve higher efficiency in operation with lower power consumption than is achieved when the setting is performed for only a single target temperature to be reached at a particular time.

Instead of setting a target temperature by a user via a GUI as in the example described above, a target temperature may be automatically set based on a behavior history of a user and/or immediately previous temperature/humidity information. In general, a temperature that a user feels comfortable is greatly dependent on an environment of an immediately previous place of the user. For example, in a case where a user enters a room after he/she returns from an outside place, a rather low temperature in the room may be comfortable for the user whose body was cooled in the outdoor environment. On the other hand, in a case where a user enters a room from an adjacent room, a rather high temperature in the room may be comfortable for the user who was in a warm environment.

To set comfortable temperature taking into account the above-described dependence of comfortable temperature on the previous environment, parameters used in setting may include the behavior of the user before entering the room, the behavior after leaving the room, temperature/humidity in the room, and temperature/humidity outside the room. The behaviors of the user may include, for example, "returning home from the outside", "staying home", "taking a bath", and/or the like. The behaviors may be set by a user or may be automatically detected using a human sensor or the like. The temperature/humidity inside/outside the room may be acquired such that temperature is detected by a temperature sensor disposed on a smartphone or a smart watch, and data of the detected temperature may be used. This makes it possible to automatically set a comfortable temperature without a user having to perform setting.

Regarding the information stored in the environment history DB 26, in addition to data in terms of time, in-room temperature, in-room humidity, outside-room temperature, outside-room humidity, air-conditioning setting information, and electric power consumption, other information may be detected by various sensors and stored in the stored in the environment history DB 26 in terms of, for example, the open/close state of the room window, the amount of light (amount of solar radiation), the sound level, the presence/absence of the user, and/or the like. This may be desirable to achieve higher accuracy in detection of change in in-room temperature. As for sensors, for example, a light intensity sensor, a sound level sensor, a human sensor, a window opening/closing detection sensor, and/or the like may be used. These sensors may be disposed at proper positions in a room of interest. The information on these may be acquired from a sensor of the air-conditioner 10 or from image data captured by a camera.

For example, the cloud server 20 may store, in the environment history DB 26, at least one of outside-room temperature history information representing a history of a change in temperature outside the living room and opening/closing history information representing a history of opening/closing of a window of the living room. The air conditioning setting unit 24 may determine, using the in-room environment predictor 23, control parameters based on at least one of the outside-room temperature history information and the opening/closing history information, in addition to the in-room temperature history information and the operation history information.

When the in-room temperature change is predicted by the in-room environment predictor 23 and the control is performed according to the prediction, if the in-room temperature is higher or lower than a predicted value by an amount equal to or larger than a threshold value (for example, when the temperature does not increase up to a predicted value in winter or does not decrease down to a predicted value in summer), there is a possibility that a window is left open or there is a failure in the air-conditioner, and thus alert may be given to a user.

This makes it possible for a user to prevent the air-conditioner 10 from uselessly operating, for example, in a situation in which a window is left open. Note that in a case where the in-room temperature is higher or lower than a predicted value by an amount equal to or larger than a threshold value, the manner of controlling the air-conditioner 10 may be adjusted, for example, such that the set temperature of the air-conditioner 10 is increased or reduced.

On the other hand, when the in-room temperature change is predicted by the in-room environment predictor 23 and the control is performed according to the prediction, if the in-room temperature is higher or lower than a predicted value by an amount equal to or larger than a threshold value (for example, when the temperature increases up to too high a value in winter or decreases down to too lower a value in summer), alert may be given to a user to notify of a possibility that there is another hear source. This makes it possible for a user to prevent the air-conditioner 10 from uselessly operating in a situation in which there is another hear rouse. Note that in a case where the in-room temperature is higher or lower than a predicted value by an amount equal to or larger than a threshold value, the manner of controlling the air-conditioner 10 may be adjusted, for example, such that the set temperature of the air-conditioner 10 is increased or reduced.

Figure 16:
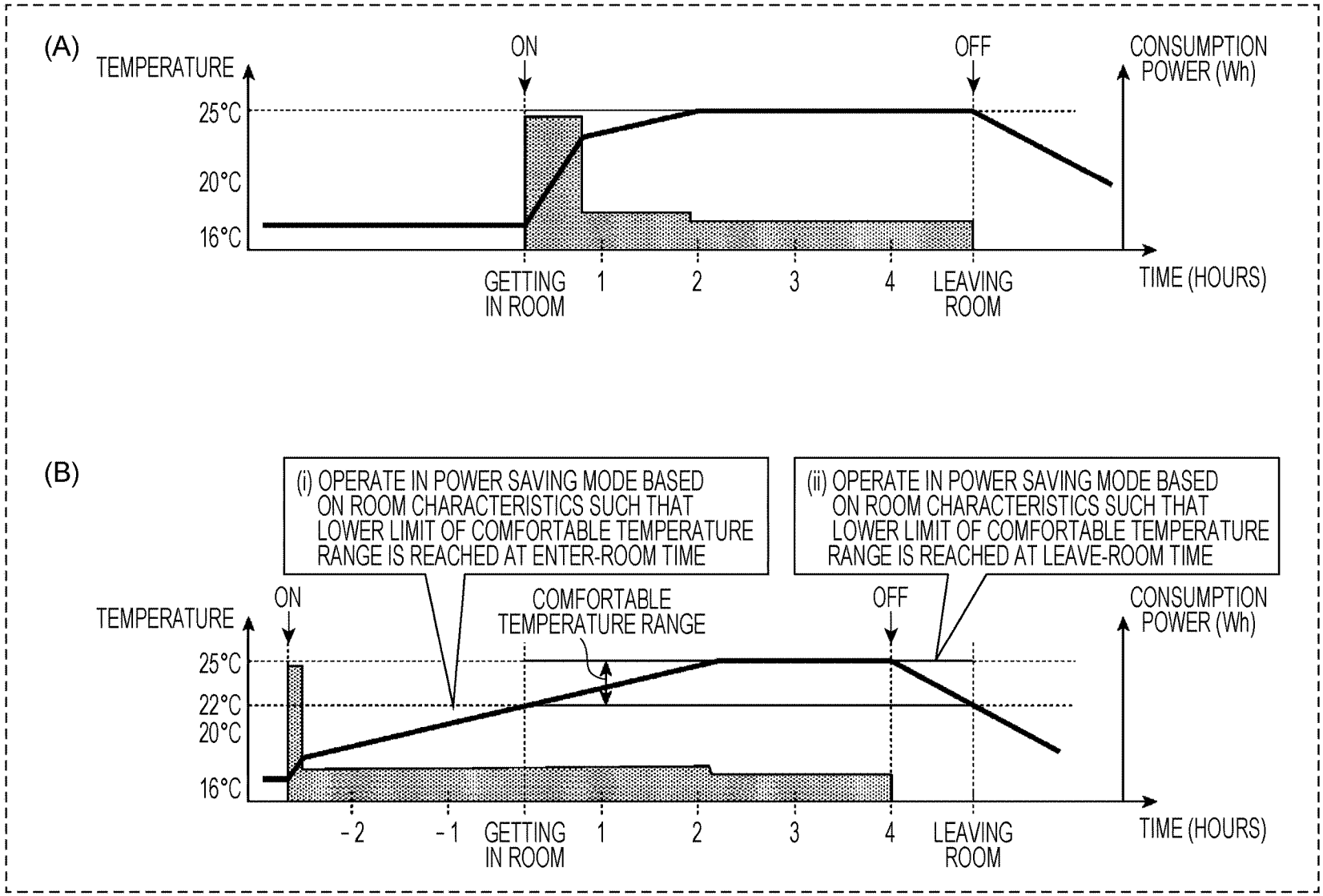
FIG. 16 is a diagram illustrating an example of a temperature control method in the air-conditioning control system shown in FIG. 1 based on a comfortable temperature range.

When the air-conditioner 10 is controlled in a period before a user enters a room, a period when the user is in the room, and period after the user leaves the room, the air-conditioner 10 may be controlled in such a manner as shown in FIG. 16. FIG. 16(A) illustrates a known method of controlling temperature, in summer, with an air-conditioner that is not connected to a network. FIG. 16(B) illustrates an example of a high energy efficiency method of controlling temperature in a comfortable temperature range in the air-conditioning control system show in FIG. 1.

In FIG. 16, a horizontal axis represents time, and a vertical axis represents temperature and electric power consumption. In FIG. 16, thin lines represent an upper limit and a lower limit of the set temperature or the comfortable temperature range, thick solid lines represent changes in in-room temperature, and hatched areas represent electric power consumption.

As shown in FIG. 16(A), in the case where the air-conditioner is not connected to a network, a user starts controlling the air-conditioner using a remote control held in a user's hand after the user enters the room. In this case, there is a large difference between the set temperature and the in-room temperature, and thus a large load is imposed on the air-conditioner 10, which results in large power consumption. Besides, the control with the remote control is started after the user enters the room, the in-room temperature is may be very low immediately after the user enters the room.

In contrast, in the temperature control shown in FIG. 16(B), the air-conditioner 10 is controlled such that the temperature is in a comfortable temperature range (for example, in a range from 22° C. to 25° C.) which is a temperature in range in which one is allowed to live comfortably.

More specifically, the environment history DB 26 stores temperature range information representing a temperature range in which a user is allowed to live comfortably, and the target temperature includes an upper limit or a lower limit of the temperature range represented by the temperature range information. The air conditioning setting unit 24 acquires, using the in-room environment predictor 23, temperature range information from the environment history DB 26 and determines a set temperature such that the lower limit (for example, 22° C.) of the comfortable temperature range is reached when a user enters the room. Next, the air conditioning setting unit 24 determines, using the in-room environment predictor 23, a set temperature such that the temperature maintained within the comfortable temperature range (for example, at 25° C.) for a period from the enter-room time to a time a particular period before a leave-room time. Furthermore, the air conditioning setting unit 24 determines using the in-room environment predictor 23 that the air-conditioner 10 is to be turned off (or the set temperature is to be reduced) before the user leaves the room such that the temperature reaches the lower limit when the user leaves the room.

The air conditioning setting unit 24 transmits, in advance, information on the operation pattern determined in the above-described manner to the air-conditioning controller 13 of the air-conditioner 10. The air-conditioner 10 starts the operation at the specified operation start time and adjusts the in-room temperature according to the notified operation pattern.

This makes it possible to control the air-conditioner 10 with high energy efficiency while maintaining the comfortability. The comfortable temperature range may be determined by a user using a GUI or the like, or automatically calculated based on an average outside temperature or the like.

The environment history data stored in the environment history DB 26 is not limited to data acquired from an internal sensor of the air-conditioner 10, but data acquired from a temperature/humidity sensor, a human sensor, or the like disposed outside the room may be used.

In the example according to the present embodiment, an improvement in efficiency of the air-conditioning control is achieved by predicting the temperature inside the room. However, predicted humidity may be taken into account in the operation pattern. For example, a discomfort index is known as a measure of one's comfortability. This index is determined by an in-room temperature and a humidity. Therefore, in view of the above, the prediction may be performed as to the humidity in the room in addition to the temperature in the room, and the setting pattern of the air-conditioner 10 may be determined so as to further include a target value of the discomfort index such that the discomfort index reaches a value equal to or smaller than the target value at the enter-room time.

In the above-described example according to the present embodiment, the temperature in the room is predicted and the air-conditioning control is controlled based on the predicted temperature thereby achieving a high efficiency in controlling the air-conditioning. However, in a case where the air-conditioner 10 has a ventilatory function, a sensed value of $CO_2$ (carbon dioxide) may be stored in the environment history DB 26, and the operation pattern may be determined taking into account a predicted value of $CO_2$. In this case, by predicting the $CO_2$ content in addition to the in-room temperature, it may be possible to determine the setting pattern in terms of the ventilatory function of the air-conditioner 10, for example, such that the $CO_2$ content is equal to or smaller than a particular value at the enter-room time.

In the above-described example according to the present embodiment, it is assumed by way of example that one air-conditioner 10 controls one room. However, in the configuration of the air-conditioning control system, the number of rooms controlled by one air-conditioner 10 is not limited to one. For example, one air-conditioner may be connected to a plurality of rooms such that the one air-conditioner controls air-conditioning of those rooms. Hereinafter, this type of air-conditioning control system will be referred to as a whole-house air-conditioning system.

Figure 17:
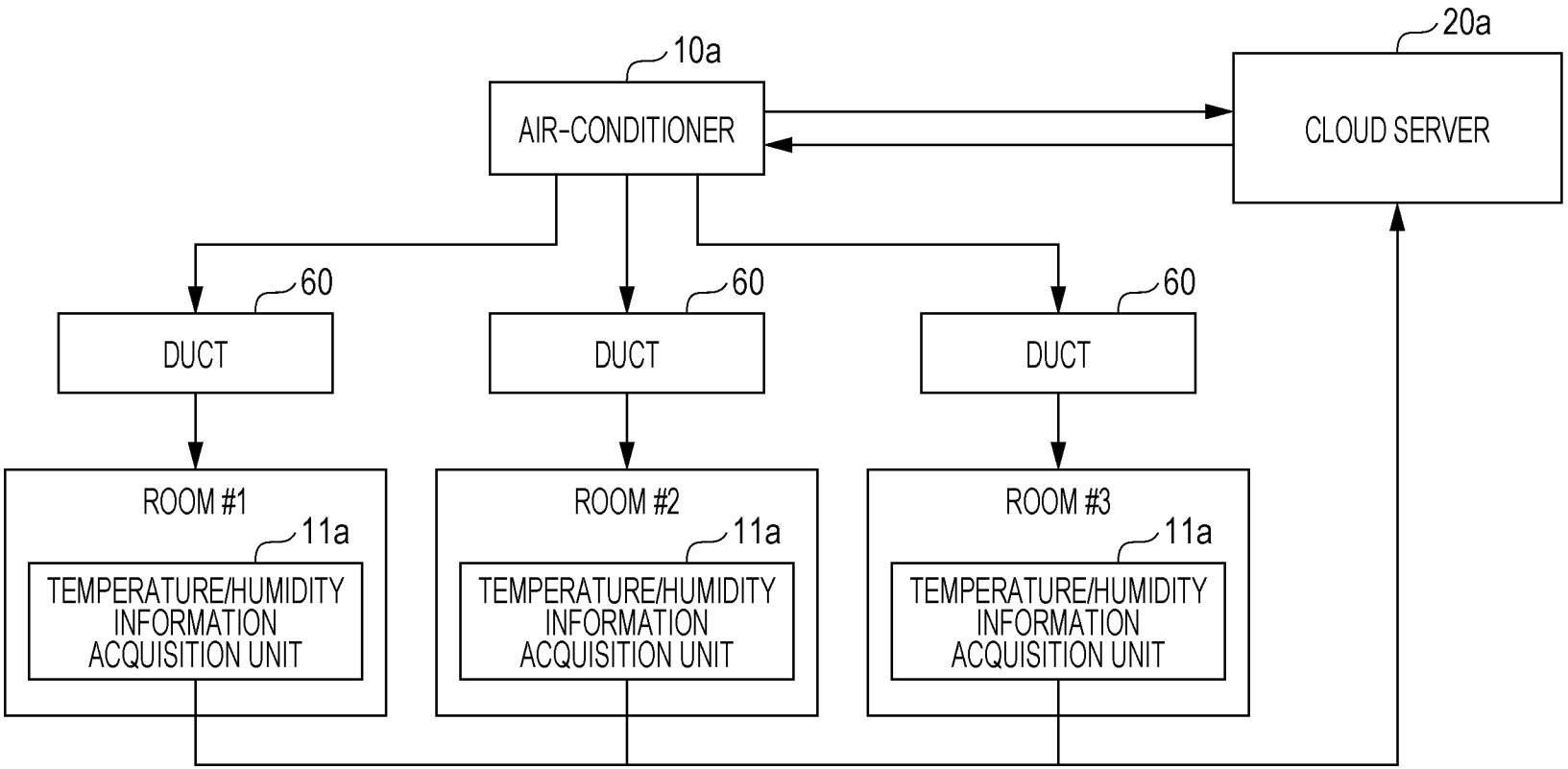
FIG. 17 is a block diagram illustrating an example of a configuration of a whole-house air-conditioning system according to an embodiment of the present disclosure.

FIG. 17 is a block diagram illustrating an example of a configuration of a whole-house air-conditioning system according to an embodiment of the present disclosure. In the whole-house air-conditioning system shown in FIG. 17, a further description of elements similar to those of the air-conditioning control system shown in FIG. 1 is omitted, and the following description focuses on differences.

In FIG. 17, an air-conditioner 10*a* is connected to three ducts 60 through which air is flowed to the respective rooms. The air-conditioner 10*a* is capable of determining amounts of cooled or heated air supplied to the respective rooms. A temperature/humidity information acquisition unit 11*a* is disposed in each room, and temperature/humidity information of each room is acquired by the temperature/humidity information acquisition unit 11*a* and is transmitted to a cloud server 20*a* via a network (not shown). Air-conditioning control information, including information on the amounts of air supplied to the respective rooms, is acquired by a control information acquisition unit 12 (not shown) of the air-conditioner 10*a* and is stored in an environment history DB 26 (not shown) of the cloud server 20*a*. The other elements in the configuration of the air-conditioner 10*a* and those of the cloud server 20*a* are similar to the elements of the air-conditioner 10 and those of the cloud server 20 shown in FIG. 1, and a further detailed description thereof is omitted.

In the whole-house air-conditioning system configured in the above-described manner, as shown in FIG. 17, by using, in an effective manner, the history information as to the temperature and the humidity of each room and the history information as to the air-conditioning control information of the air-conditioner 10*a*, the in-room environment predictor 23 (not shown) of the cloud server 20*a* is capable of predicting the temperature and the humidity for each of the rooms separately and capable of controlling the air-conditioner based on the predicted temperature and humidity.

The whole-house air-conditioning system according to the present embodiment has been described above.

Overview of Services Provided

Figure 18:
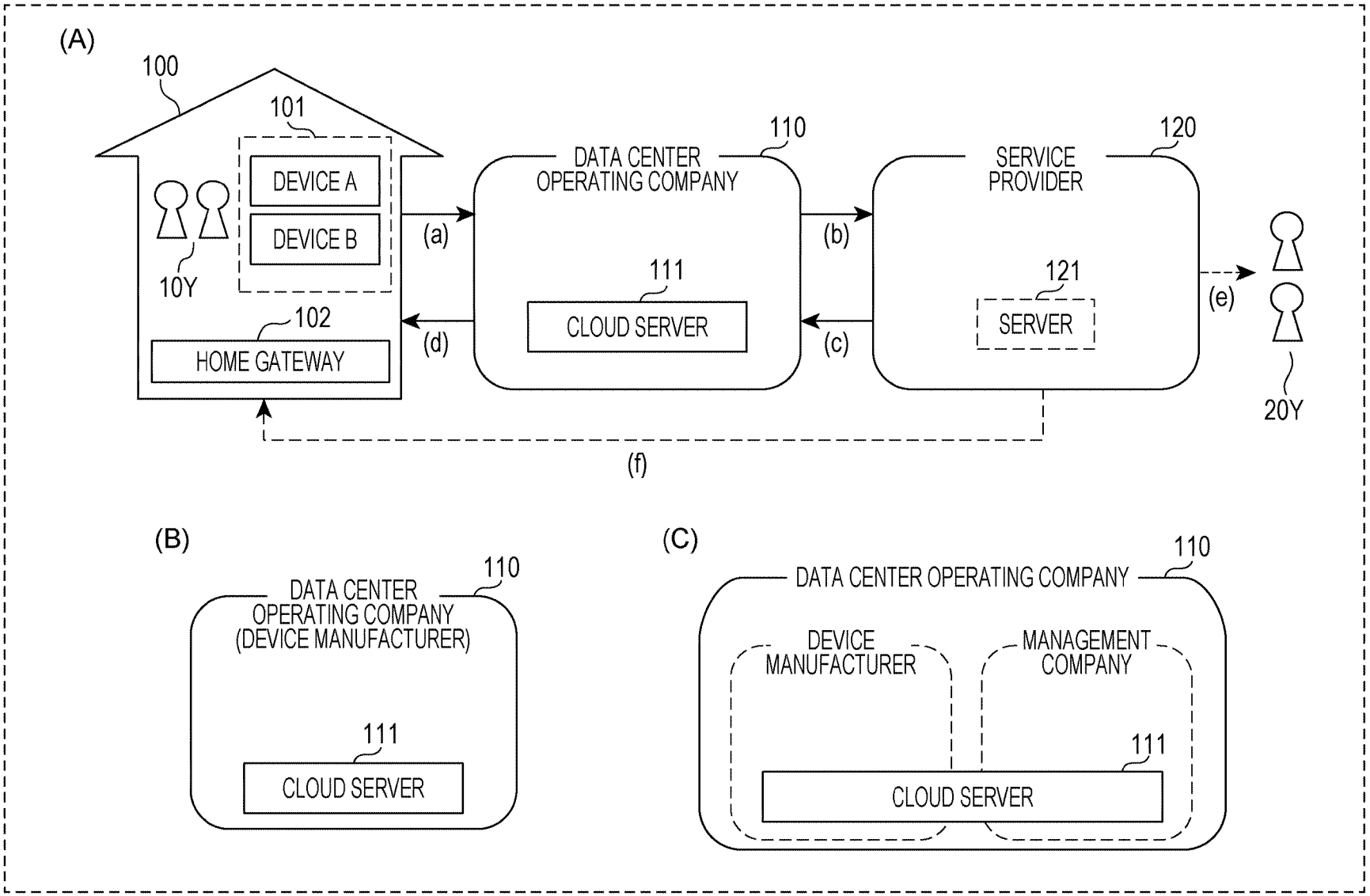
FIG. 18 is a diagram illustrating an outline of services provided according to an embodiment of the present disclosure.

FIG. 18(A) illustrates an overview of services according to the present embodiment. For example, All or part of blocks of the cloud server 20 described above belong to a cloud server 111 of a data center operating company 110 or a server 121 of a service provider 120 shown in FIG. 18.

A group 100 is, for example, a company, an association, a home, or the like, and there is no restriction on the size thereof. The group 100 includes a plurality of devices 101 such as a device A and device B, and a home gateway 102. The plurality of devices 101 may include a device (for example, a smartphone, a PC, a TV set, etc.) connectable to the Internet, and a device (for example, an illumination, a washing machine, a refrigerator, etc.) that is not capable of being directly connected to the Internet. When a device is not capable of being directly connected to the Internet, the device may be connected to the Internet via the home gateway 102. The group 100 includes a plurality of users 10Y who use the plurality of devices 101.

The data center operating company 110 includes a cloud server 111. The cloud server 111 refers to a virtual server capable of being connected to various devices via the Internet. The cloud server 111 manages mainly big data difficult to be dealt with by a normal database management tool. The data center operating company 110 manages data and also manages the cloud server 111. To this end, the data center operating company 110 operates a data center that manages data and the cloud server 111. Services performed by the data center operating company 110 will be described in further detail later. Note that the data center operating company 110 is not limited to companies whose job is only to manage data or operate the cloud server 111. For example, when a device manufacturer develops and produces one of the plurality of devices 101, if this device manufacturer also manages data or manages the cloud server 111 or the like, this device manufacturer may be an example of a data center operating company 110 (see FIG. 18(B)). Note that the data center operating company 110 does not necessarily need to be one company. For example, in a case where a device manufacturer and a management company different from the device manufacturer manage data or operate a cloud server 111 together or in cooperation, both or one of them is an example of the data center operating company 110 (FIG. 18(C)).

The service provider 120 includes a server 121. There is no particular restriction on the size of the server 121 usable herein. For example, a memory in a personal computer or the like may be used as the server 121. In some cases, the service provider may not include the server 121.

In the service described above, the home gateway 102 does not necessarily need to be provided. For example, in a case where the cloud server 111 performs all data management, the home gateway 102 is not necessary. In a case where all devices at home are connected to the Internet, there is no such a device that is not capable of being directly connected to the Internet.

Next, a flow of processing log information (handling history information, operation history information, etc.) in the services described above is described below.

First, the device A or the device B in the group 100 transmits log information to the cloud server 111 of the data center operating company 110. The cloud server 111 accumulates log information associated with the device A or the device B ((a) in FIG. 18(A)). The log information is information representing, for example, an operation status, an operation date/time, and the like of the plurality of devices 101. Examples of the log information include programmed record setting information of a recorder, an operating date/time of a washing machine and amount of laundry, date/time of opening/closing a refrigerator and the number of times the refrigerator is opened and closed, and the like, but the log information is not limited to these examples, and other various kinds of information acquired from various kinds of devices may be log information. In some cases, log information is provided from the plurality of devices 101 directly to the cloud server 111 via the Internet. Log information from the plurality of devices 101 may be once accumulated in the home gateway 102, and then the log information may be provided from the home gateway 102 to the cloud server 111.

Thereafter, the cloud server 111 of the data center operating company 110 provides the accumulated log information in particular units to the service provider 120. Herein, the unit employed in providing log information may be such a unit that is convenient for rearranging the information and providing it to the service provider 120, or such a unit specified by the service provider 120. The unit may have a fixed length, or the length of the unit may be variable such that the amount of provided information varies depending on a situation. The log information may be stored, as required, in the server 121 in the service provider 120 ((b) in FIG. 18(A)). The service provider 120 rearranges the log information in a form suitable for a service provided to a user, and the service provider 120 provides the rearranged log information to the user. The user, to which the log information is provided, may be users 10Y who use the plurality of devices 101 or external users 20Y. As for the method of providing a service to a user, for example, the service may be directly provided to the user from the service provider ((f), (e) in FIG. 18(A)). Alternatively, a service may be provided to users, for example, such that the service is retransferred to the cloud server 111 of the data center operating company 110 and then provided to the user from the cloud server 111 ((c), (d) in FIG. 18(A)). The cloud server 111 of the data center operating company 110 may arrange the log information into a form convenient for a service provided to a user, and the cloud server 111 may provide resultant information to the service provider 120.

Note that the users 10Y may be different from the users 20Y or they may be the same.

The techniques described above in the embodiments may be realized in various types of cloud services as described below. Note that the types of cloud services in which the techniques according to the embodiments are not limited to those described below.

First Type of Service (in-House Data Center Type)

Figure 19:
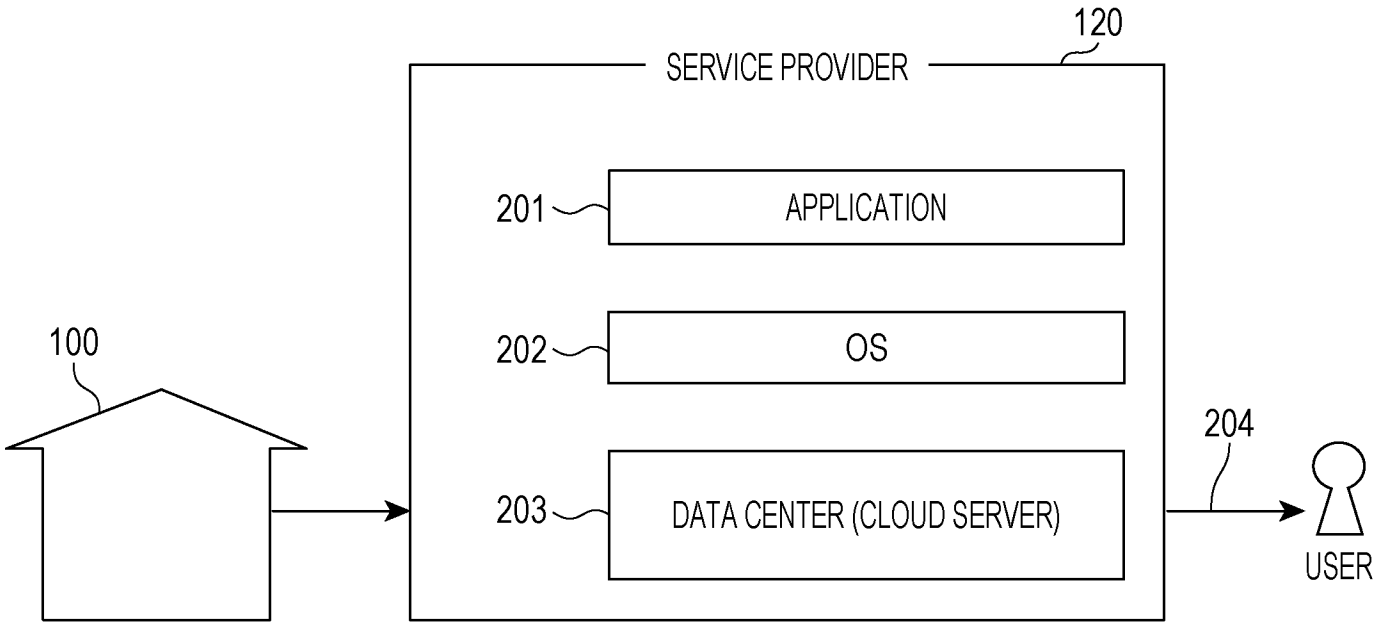
FIG. 19 is a diagram illustrating a type of service (in-house data center type) according to an embodiment of the present disclosure.

FIG. 19 is a diagram illustrating a first type of service (in-house data center type). In this type of service, the service provider 120 acquires information from the group 100 and provides service to the users. In this type of service, the service provider 120 has a function of a data center operating company. That is, the service provider has the cloud server 111 that manages big data. Thus, in this case, there is no data center operating company.

In this type of service, the service provider 120 operates a data center (the cloud server 111) and manages it (203). The service provider 120 also manages an OS (202) and an application (201). Using the OS (202) and the application (201) managed by the service provider 120, the service provider 120 provides service (204).

Second Type of Service (IaaS-Based Type)

Figure 20:
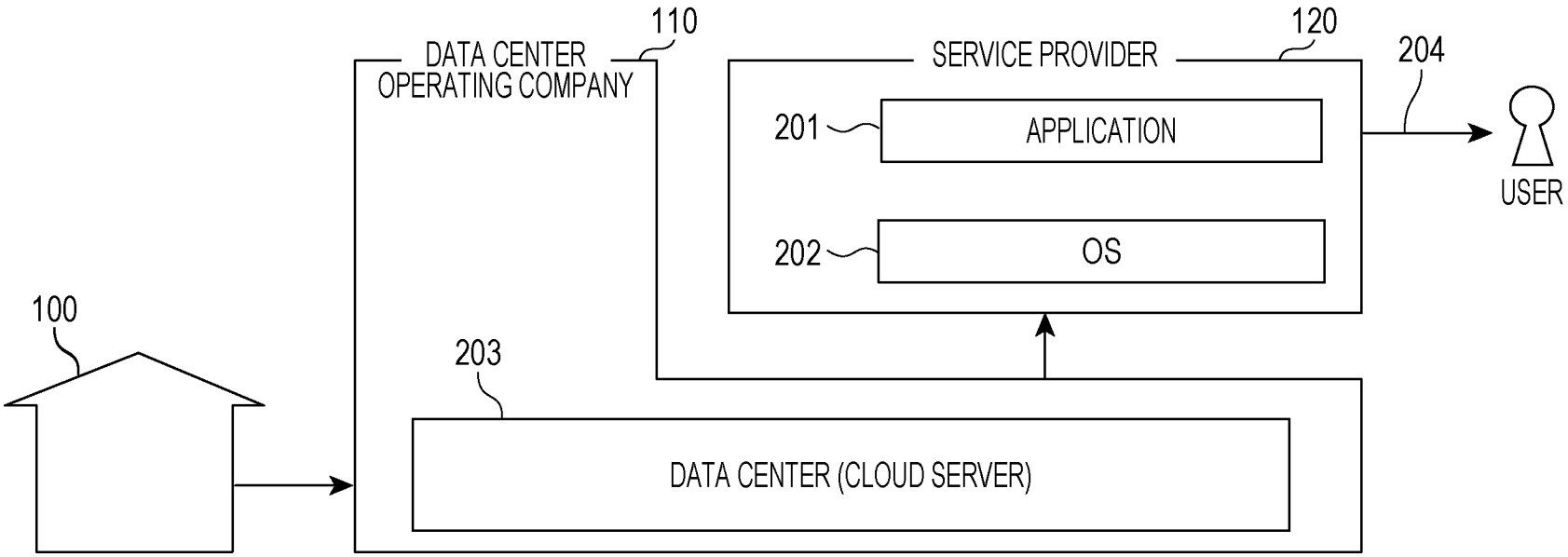
FIG. 20 is a diagram illustrating a type of service (IaaS-based type) according to an embodiment of the present disclosure.

FIG. 20 illustrates a second type of service (IaaS-based type). IaaS stands for infrastructure as a service, and is a cloud service providing model in which a base for building and operating a computer system is provided as a service via the Internet.

In this type of service, a data center operating company operates a data center (cloud server 111) and manages it (203). The service provider 120 manages the OS (202) and the application (201). Using the OS (202) and the application (201) managed by the service provider 120, the service provider 120 provides service (204).

Third Type of Service (PaaS-Based Type)

Figure 21:
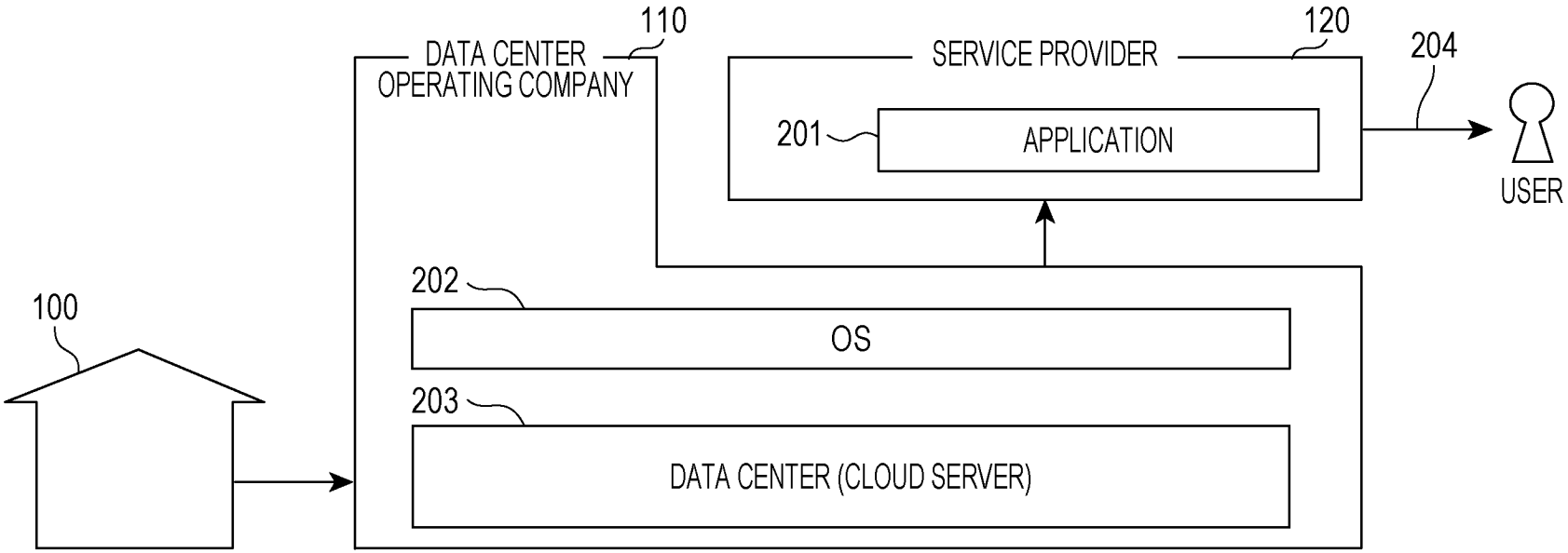
FIG. 21 is a diagram illustrating a type of service (PaaS-based type) according to an embodiment of the present disclosure.

FIG. 21 illustrates a third type of service (PaaS-based type). PaaS stands for platform as a service, and is a cloud service providing model in which a platform functioning as a base in building and operating software is provided as a service via the Internet.

In this type of service, the data center operating company 110 manages the OS (202), and operates a data center (the cloud server 111) and manages it (203). The service provider 120 manages the application (201). The service provider 120 provides service (204) using the OS (202) managed by the data center operating company and the application (201) managed by the service provider 120.

Fourth Type of Service (SaaS-Based Type)

Figure 22:
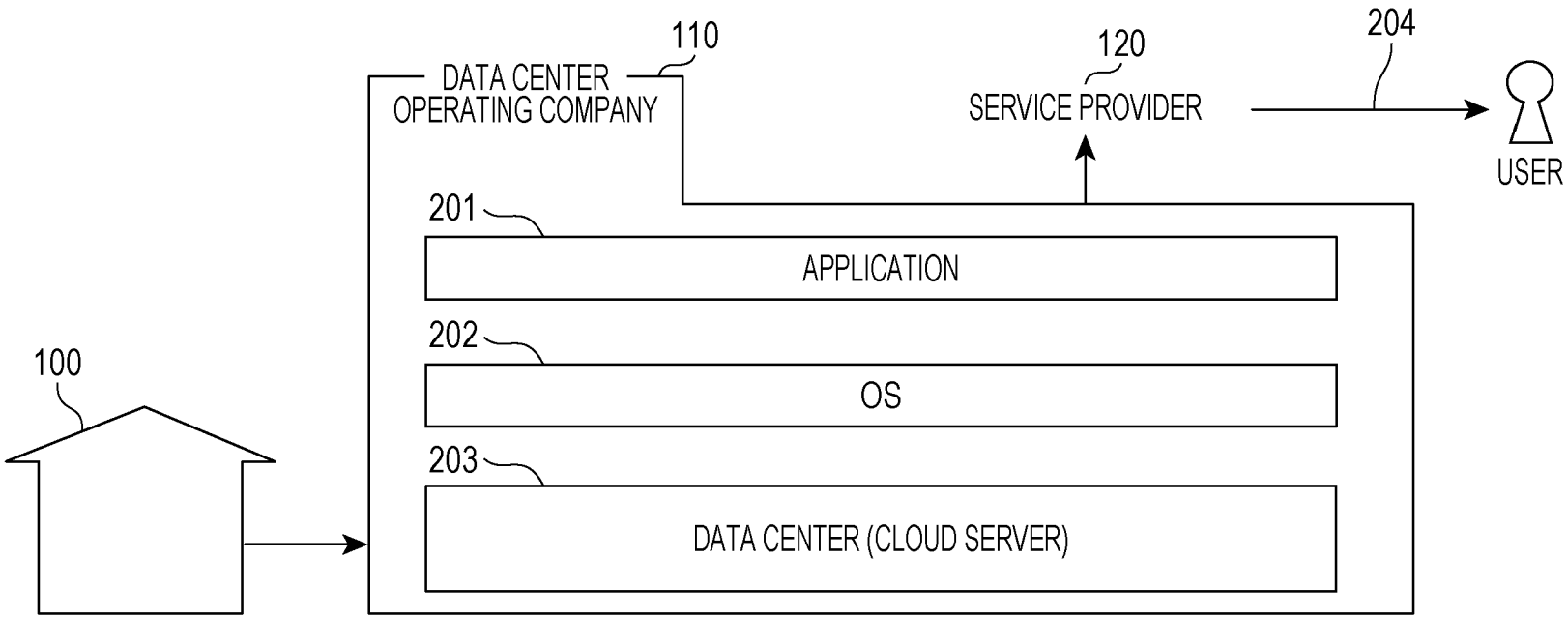
FIG. 22 is a diagram illustrating a type of service (SaaS-based type) according to an embodiment of the present disclosure.

FIG. 22 illustrates a fourth type of service (SaaS-based type). SsaS stands for software as a service, and SsaS is a cloud service providing model in which, for example, an application provided by a platform provider having a data center (cloud server) is provided to a company or an individual (user) that does not have a data center (cloud server) such that the company or the individual (user) is allowed to use the application via a network such as the Internet or the like.

In this type of service, the data center operating company 110 manages the application (201) and the OS (202), and operates a data center (cloud server 111) and manages it (203). The service provider 120 provides service (204) using the OS (202) and the application (201) managed by the data center operating company 110.

In each type of service described above, it is assumed that service is provided by the service provider 120. The service provider or the data center operating company may develop for itself the OS, the application, and/or the big data, or may ask a third party to develop the OS, the application, and/or the big data.

The air-conditioning control system according to any one of embodiments of the present disclosure is capable of controlling an air-conditioner with high energy efficiency such that a comfortable environment is provided to a user, and thus the air-conditioning control system is very useful in various applications of home-use electrical appliance.

What is claimed is:

1. An air-conditioning control method for an air-conditioning control apparatus connected to an air-conditioning apparatus via a network, comprising:

storing, in a database, in-room temperature history information, representing a history of an in-room temperature change in a room whose temperature is adjusted by the air-conditioning apparatus, in relation to operation history information, representing an operation history of the air-conditioning apparatus;

storing, in the database, power consumption history information representing a history of electric power consumption of the air-conditioning apparatus;

predicting, as a predicted off-state in-room temperature, a future in-room temperature of the room based on the in-room temperature history information and the operation history information for a case where the temperature is not adjusted by the air-conditioning apparatus;

predicting, as a predicted on-state in-room temperature, a future in-room temperature of the room based on the in-room temperature history information and the operation history information for the case where the temperature is adjusted by the air-conditioning apparatus;

predicting, as a predicted on-state electric power consumption, a future electric power consumption of the air-conditioning apparatus based on the in-room temperature history information, the operation history information, and the power consumption history information for the case where the temperature is adjusted by the air-conditioning apparatus; and determining a control parameter of the air-conditioning apparatus based on the predicted off-state in-room temperature, the predicted on-state in-room temperature and the predicted on-state electric power consumption, the control parameter being used for controlling the in-room temperature of the room to reach a target temperature at a target time.

2. The air-conditioning control method according to claim 1, further comprising:

receiving target temperature information representing the target temperature of the room whose temperature is adjusted by the air-conditioning apparatus, and set time information representing the target time at which the temperature of the room is controlled so as to reach the target temperature;

determining the control parameter of the air-conditioning apparatus based on the predicted off-state in-room temperature such that the in-room temperature of the room reaches the target temperature indicated by the target temperature information at the target time indicated by the set time information; and transmitting, to the air-conditioning apparatus, control command information including the determined control parameter, the control command information indicating an operation command to operate the air-conditioning apparatus according to the control parameter.

3. The air-conditioning control method according to claim 1, wherein the control parameter includes start time information indicating a time at which to start an operation of the air-conditioning apparatus.

4. The air-conditioning control method according to claim 1, wherein the control parameter includes operation pattern information indicating an operation pattern according to which to operate the air-conditioning apparatus.

5. The air-conditioning control method according to claim 1, further comprising:

storing at least one of enter-room history information representing enter-room history of a user in the room and leave-room history information representing leave-room history of the user from the room, and estimating a usage time at which the user uses the room based on at least one of the enter-room history information and the leave-room history information, and determining the usage time as the target time.

6. The air-conditioning control method according to claim 5, further comprising receiving, via the network, a result of a detection by a human sensor disposed in the room in terms of whether the user is present or absent in the room, and updating at least one of the enter-room history information and the leave-room history information based on the result of the detection by the human sensor.

7. The air-conditioning control method according to claim 5, further comprising:

receiving, via the network, GPS information on an information terminal possessed by the user;

determining at least one of the user entering the room and the user leaving the room based on the GPS information received from the information terminal; and updating at least one of the enter-room history information and the leave-room history information based on the determined at least one of the entering room and the leaving room.

8. The air-conditioning control method according to claim 1, further comprising:

storing, in the database, at least one of outside-room temperature history information representing a history of a change in temperature outside the room and opening/closing history information representing a history of opening/closing of a window of the room; and determining the control parameter based on the in-room temperature history information and the operation history information and further at least one of the outside-room temperature history information and the opening/closing history information.

9. The air-conditioning control method according to claim 1, further comprising storing, in the database, temperature range information indicating a temperature range in which the user is allowed to live comfortably, wherein the target temperature includes an upper limit or a lower limit of the temperature range indicated by the temperature range information.

10. The air-conditioning control method according to claim 1, further comprising in a case where it is not detected that the user enters the room in a period from the target time to a time a predetermined period after the target time, transmitting stop command information to the air-conditioning apparatus via the network to stop the operation of the air-conditioning apparatus.

11. A non-transitory computer-readable storage medium storing a program for causing a computer to execute a process so as to function as an air-conditioning control apparatus connected to an air-conditioning apparatus via a network, the process comprising:

storing, in a database, in-room temperature history information representing a history of an in-room temperature change in a room whose temperature is adjusted by the air-conditioning apparatus in relation to operation history information representing an operation history of the air-conditioning apparatus;

storing, in the database, power consumption history information representing a history of electric power consumption of the air-conditioning apparatus;

predicting, as a predicted off-state in-room temperature, a future in-room temperature of the room based on the in-room temperature history information and the operation history information for a case where the temperature is not adjusted by the air-conditioning apparatus;

predicting, as a predicted on-state in-room temperature, a future in-room temperature of the room based on the in-room temperature history information and the operation history information for the case where the temperature is adjusted by the air-conditioning apparatus;

predicting, as a predicted on-state electric power consumption, a future electric power consumption of the air-conditioning apparatus based on the in-room temperature history information, the operation history information, and the power consumption history information for the case where the temperature is adjusted by the air-conditioning apparatus; and determining a control parameter of the air-conditioning apparatus based on the predicted off-state in-room temperature, the predicted on-state in-room temperature and the predicted on-state electric power consumption, the control parameter being used for controlling the in-room temperature of the room to reach a target temperature at a target time.

* * * * *